US010695620B2

(12) United States Patent
Stokke et al.

(10) Patent No.: US 10,695,620 B2
(45) Date of Patent: Jun. 30, 2020

(54) CLUB HEADS WITH BOUNDED FACE TO BODY YIELD STRENGTH RATIO AND RELATED METHODS

(71) Applicant: KARSTEN MANUFACTURING CORPORATION, Phoenix, AZ (US)

(72) Inventors: Ryan M. Stokke, Anthem, AZ (US); Eric J. Morales, Laveen, AZ (US); Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/276,576

(22) Filed: Sep. 26, 2016

(65) Prior Publication Data

US 2017/0007893 A1 Jan. 12, 2017

Related U.S. Application Data

(63) Continuation-in-part of application No. 14/072,190, filed on Nov. 5, 2013, now abandoned.

(60) Provisional application No. 62/334,623, filed on May 11, 2016.

(51) Int. Cl.
*A63B 53/04* (2015.01)

(52) U.S. Cl.
CPC ..... *A63B 53/0466* (2013.01); *A63B 53/04* (2013.01); *A63B 2053/042* (2013.01); *A63B 2053/0408* (2013.01); *A63B 2209/00* (2013.01); *Y10T 29/49826* (2015.01)

(58) Field of Classification Search
CPC ..... Y10T 29/49826; A63B 53/0466; A63B 53/04; A63B 2053/042; A63B 2053/0408
USPC ..... 473/324–350, 287–292
See application file for complete search history.

(56) References Cited

U.S. PATENT DOCUMENTS

| | | | | |
|---|---|---|---|---|
| 3,653,250 | A * | 4/1972 | Collins | B21C 37/00 148/577 |
| 3,969,155 | A * | 7/1976 | McKeighen | C22F 1/183 148/671 |
| 4,398,965 | A * | 8/1983 | Campau | A63B 53/04 148/522 |
| 5,087,415 | A | 2/1992 | Hemphill et al. | |
| 5,268,044 | A | 12/1993 | Hemphill et al. | |
| 5,681,528 | A | 10/1997 | Martin et al. | |
| 5,855,844 | A | 1/1999 | Martin | |
| 5,866,066 | A | 2/1999 | Hemphill et al. | |
| 6,348,015 | B1 | 2/2002 | Kosmatka | |
| 6,478,692 | B2 | 11/2002 | Kosmatka | |
| 6,595,057 | B2 | 7/2003 | Bissonnette et al. | |
| 6,605,007 | B1 | 8/2003 | Bissonnette et al. | |
| 6,630,103 | B2 | 10/2003 | Martin et al. | |

(Continued)

FOREIGN PATENT DOCUMENTS

WO 200168195 9/2001

OTHER PUBLICATIONS

TourAlloys® Family of Golf Club Alloys Kit—Carpenter Technology, http://pdf.directindustry.com/pdf/carpenter-D technology/touralloys-family-golf-club-alloys-kit/28752-61989-_4.html.

(Continued)

*Primary Examiner* — Sebastiano Passaniti

(57) ABSTRACT

Some embodiments include a club head with a bounded face to body yield strength ratio. Other embodiments of related club heads and methods are also disclosed.

20 Claims, 4 Drawing Sheets

(56) References Cited

U.S. PATENT DOCUMENTS 6,669,579 B2 12/2003 Kosmatka
6,685,576 B2 2/2004 Kosmatka
6,723,007 B1 4/2004 Chao
6,949,032 B2 9/2005 Kosmatka
6,960,142 B2 11/2005 Bissonnette et al.
7,029,403 B2 4/2006 Rice et al.
7,041,003 B2 5/2006 Bissonnette et al.
7,082,665 B2 * 8/2006 Deshmukh ..... A63B 53/0466 29/469
7,140,975 B2 11/2006 Bissonnette et al.
7,153,221 B2 12/2006 Hocknell et al.
7,169,057 B2 1/2007 Wood et al.
7,169,059 B2 1/2007 Rice et al.
7,207,898 B2 4/2007 Rice et al.
7,214,142 B2 5/2007 Meyer et al.
7,261,643 B2 8/2007 Rice et al.
7,278,925 B2 10/2007 Oyama
7,297,072 B2 11/2007 Meyer et al.
7,361,099 B2 4/2008 Rice et al.
7,367,899 B2 5/2008 Rice et al.
7,402,113 B2 * 7/2008 Mori ..... A63B 53/0466 473/345
7,422,527 B2 9/2008 Rice et al.
7,431,664 B2 10/2008 Meyer et al.
7,520,819 B2 4/2009 Rice et al.
7,537,528 B2 5/2009 Rice et al.
7,549,934 B2 6/2009 Rice
7,553,242 B2 6/2009 Meyer et al.
7,578,754 B2 8/2009 Nakamura
7,682,262 B2 3/2010 Soracco et al.
7,704,162 B2 4/2010 Rice et al.
7,762,907 B2 7/2010 Rice
7,850,541 B2 12/2010 Meyer et al.
7,850,543 B2 12/2010 Rice et al.
7,850,544 B2 12/2010 Meyer et al.
7,892,109 B2 2/2011 Rice et al.
7,931,545 B2 4/2011 Soracco et al.
7,935,001 B2 5/2011 Meyer et al.
7,980,963 B2 7/2011 Rice et al.
8,025,590 B2 9/2011 Rice et al.
8,038,544 B2 10/2011 Meyer et al.
8,047,930 B2 11/2011 Rice et al.
8,128,509 B2 3/2012 Soracco et al.
8,214,992 B2 7/2012 Hirano
8,262,502 B2 9/2012 Rice et al.
8,277,334 B2 10/2012 Meyer et al.
8,342,982 B2 1/2013 Clausen et al.
8,409,032 B2 * 4/2013 Myrhum ..... A63B 53/0466 473/342
8,439,769 B2 5/2013 Rice et al.
8,449,407 B2 5/2013 Rice et al.
8,517,858 B2 8/2013 Soracco et al.
2001/0051549 A1 * 12/2001 Inoue ..... A63B 53/04 473/342
2002/0107090 A1 8/2002 Matsumoto et al.
2003/0203767 A1 10/2003 Burnett et al.
2003/0203769 A1 10/2003 Burnett et al.
2003/0204946 A1 11/2003 Burnett et al.
2004/0157677 A1 8/2004 Roach et al.
2006/0032556 A1 * 2/2006 Nasserrafi ..... A63B 53/04 148/225
2006/0094531 A1 5/2006 Bissonnette et al.
2006/0128501 A1 6/2006 Rice
2006/0135286 A1 6/2006 Imamoto et al.
2006/0293118 A1 12/2006 Meyer et al.
2007/0209738 A1 * 9/2007 Liu ..... A63B 53/04 148/329
2008/0132356 A1 6/2008 Chao et al.
2008/0178456 A1 7/2008 Rice et al.
2008/0227566 A1 * 9/2008 Lin ..... A63B 53/04 473/349
2008/0283162 A1 * 11/2008 Chiang ..... A63B 53/04 148/671
2009/0082133 A1 3/2009 Tseng
2010/0108203 A1 * 5/2010 Kosa ..... C21D 6/001 148/542
2010/0178996 A1 7/2010 Chao
2010/0255929 A1 10/2010 Soracco et al.
2011/0118057 A1 * 5/2011 Roach ..... A63B 53/04 473/342
2012/0077617 A1 * 3/2012 Hu ..... A63B 53/0466 473/349
2012/0184394 A1 * 7/2012 Boyd ..... A63B 53/0466 473/342
2013/0040754 A1 * 2/2013 Morin ..... A63B 53/04 473/329
2013/0225316 A1 8/2013 Cole et al.

OTHER PUBLICATIONS

International Search Report and Written Opinion of related U.S. Appl. No. 14/072,190 , entitled "Club Heads With Bounded Face to Body Yield Strength Ratio and Related Methods", filed Nov. 5, 2013.

* cited by examiner

601

602

CLUB HEADS WITH BOUNDED FACE TO BODY YIELD STRENGTH RATIO AND RELATED METHODS

CROSS REFERENCE TO RELATED APPLICATIONS

This claims the benefit of U.S. Provisional Patent Appl. No. 62/334,623, filed on May 11, 2016, and is a continuation in part of U.S. patent application Ser. No. 14/072,190, filed on Nov. 5, 2013, the contents of which are incorporated herein by reference in their entirety.

TECHNICAL FIELD

This disclosure relates generally to sports equipment, and relates more particularly to club heads and related methods.

BACKGROUND

Various characteristics of a golf club can affect the performance of the golf club. For example, the center of gravity, the moment of inertia, and the coefficient of restitution of the club head of the golf club are each characteristics of a golf club that can affect performance.

The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

Further, the coefficient of restitution of the club head of the golf club can be a function of at least the flexibility of the face of the club head. Meanwhile, the flexibility of the face of the club head can be a function of the geometry (e.g., height, width, and/or thickness) of the face and/or the material properties (e.g., Young's modulus) of the face. That is, maximizing the height and/or width of the face, and/or minimizing the thickness and/or Young's modulus of the face, can increase the flexibility of the face, thereby increasing the coefficient of restitution of the club head; and increasing the coefficient of restitution of the club head of the golf club, which is essentially a measure of the efficiency of energy transfer from the club head to a golf ball, can increase the distance the golf ball travels after impact.

BRIEF DESCRIPTION OF THE DRAWINGS

To facilitate further description of the embodiments, the following drawings are provided in which.

Figure 1:
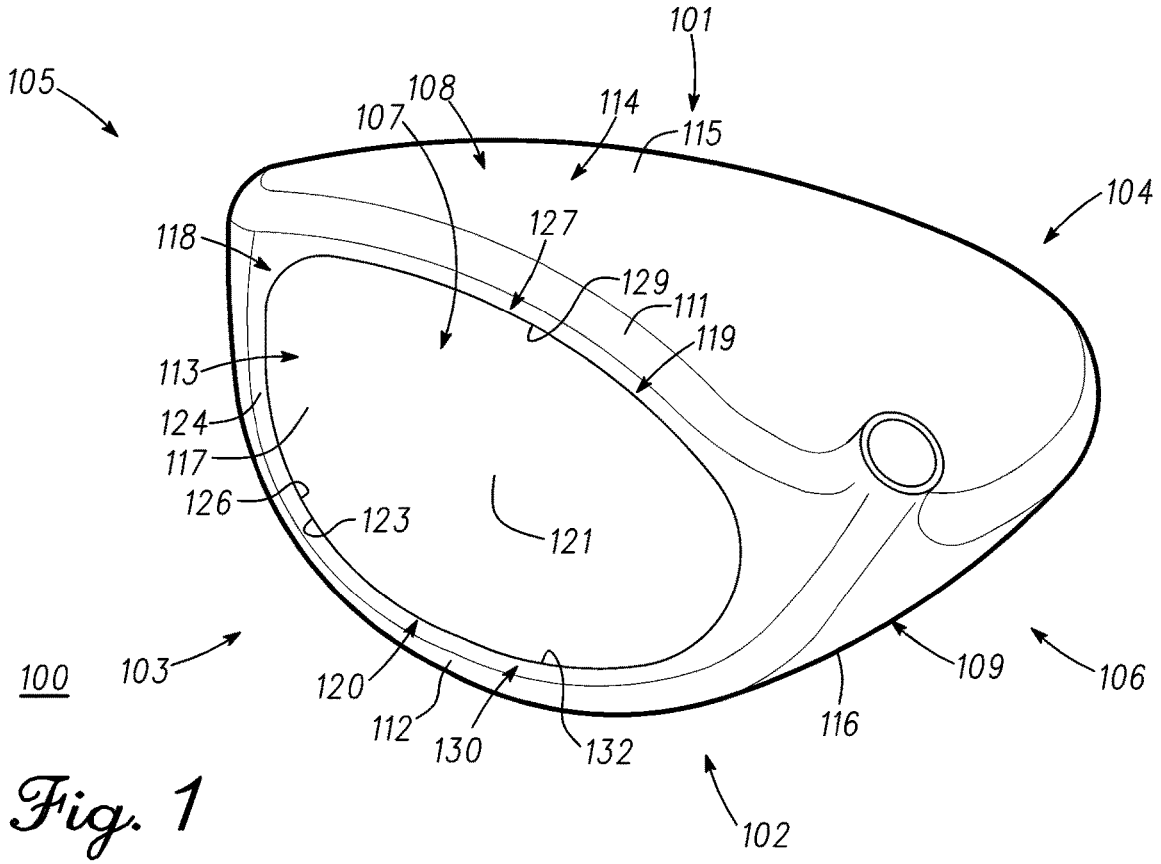
FIG. 1 illustrates a front, top, heel side view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

DESCRIPTION

Some embodiments include a golf club head. The gold club head can comprise a face portion and a support body. The face portion can comprise a first material, and the support body can comprise a second material. Further, the first material can comprise a yield strength of the first material, and the second material can comprise a yield strength of the second material. The yield strength ratio of the yield strength of the second material to the yield strength of the first material can be greater than or equal to approximately 0.50. Likewise, the yield strength of the first material can be greater than or equal to approximately 1378 MegaPascals.

Other embodiments include a method of manufacturing a golf club head. The method can comprise: providing a face portion; and providing a support body. The face portion can comprise a first material, and the support body can comprise a second material. Further, the first material can comprise a yield strength of the first material, and the second material can comprise a yield strength of the second material. The yield strength ratio of the yield strength of the second material to the yield strength of the first material can be greater than or equal to approximately 0.50. Likewise, the yield strength of the first material can be greater than or equal to approximately 1378 MegaPascals.

Further embodiments include a golf club head. The gold club head can comprise a face portion and a support body. The face portion can comprise a first material, and the support body can comprise a second material. Further, the first material can comprise a yield strength of the first material, and the second material can comprise a yield strength of the second material. The yield strength ratio of the yield strength of the second material to the yield strength of the first material can be greater than or equal to approximately 0.50. Likewise, the yield strength of the first material can be greater than or equal to approximately 1378 MegaPascals. Meanwhile, the face portion can be coupled to the support body, the support body can comprise a support shell, and the golf club head can comprise a wood-type golf club head.

Turning to the drawings, FIG. 1 illustrates a front, top, heel side view of a club head 100, according to an embodiment. Club head 100 is merely exemplary and is not limited to the embodiments presented herein. Club head 100 can be employed in many different embodiments or examples not specifically depicted or described herein.

Regarding club head 100 generally, club head 100 can comprise a golf club head. The golf club head can be part of a corresponding golf club. Further, the golf club head can be part of a set of golf club heads, and/or the golf club can be part of a set of golf clubs. For example, club head 100 can comprise any suitable wood-type golf club head (e.g., a driver club head, a fairway wood club head, a hybrid club head, etc.). In many embodiments, club head 100 can comprise a metal wood-type golf club head, but in these or other embodiments, club head 100 can comprise any suitable materials, provided the materials satisfy certain material strength conditions as discussed below. Nonetheless, although club head 100 is generally described in implementation with respect to a wood-type golf club head, club head 100 can also be implemented with any other suitable golf club head-type. The apparatus, methods, and articles of manufactured described herein are not limited in this regard.

Club head 100 comprises a top end 101, a bottom end 102 opposite top end 101, a front end 103, a rear end 104 opposite front end 103, a toe end 105, and a heel end 106 opposite toe end 105, which provide convenient points of reference when discussing the elements of club head 100. In many embodiments, club head 100 can comprise a face 107, a crown 108, a sole 109, and/or a skirt (not illustrated). In some embodiments, sole 109 can comprise the skirt. Also, club head 100 can comprise either (i) a hosel and/or a hosel transition portion, or (ii) a bore. Nonetheless, in some embodiments, one or more of the skirt, the hosel, the hosel transition portion, and the bore can be omitted.

Face 107 can be located at front end 103. Meanwhile, crown 108 can be at least partially located at top end 101, and can interface with face 107 at top end 101, such as, for example, at a crown intersection 111 of club head 100. Further, sole 109 can be at least partially located at bottom end 102, and can interface with face 107 at bottom end 102, such as, for example, at a sole intersection 112 of club head 100. In many examples, crown intersection 111 and/or sole intersection 112 can be curved or faceted, providing smooth (or substantially smooth) transitions between face 107 and crown 108 and/or face 107 and sole 108, respectively. In these embodiments, crown intersection 111 can refer to a crown radius of club head 100 and/or sole intersection 112 can refer to a lead edge radius of club head 100. In other embodiments, crown intersection 111 and/or sole intersection 112 can be angular, providing sharp transitions between face 107 and crown 108 and/or face 107 and sole 109, respectively.

When implemented, the skirt can be located between crown 108 and sole 109, and can extend between toe end 105 and heel end 106. In some embodiments, the skirt can extend between crown 108 and sole 109 completely around to face 107 at toe end 105 and/or at heel end 106, while in other embodiments, the skirt surface can extend less than all of the way to face 107 at toe end 105 and/or at heel end 106.

In some embodiments, crown 108 and sole 109 can interface with each other, such as, for example, at rear end 104, toe end 105, and/or heel end 106. However, in other embodiments, such as, for example, when club head 100 comprises the skirt, and the skirt extends from face 107 at toe end 105 to face surface 107 at heel end 106, crown 108 and sole 109 may not interface with each other at all, but rather with the skirt. Like with crown intersection 111 and/or sole intersection 112, the interfaces of crown 108 and sole 109 with each other and/or with the skirt can be smooth and/or sharp. Further, when applicable, the interfaces of the skirt with face 107 can also be smooth and/or sharp.

Face 107 can refer to a striking face of club head 100, and can comprise a face surface configured to impact a ball (not shown), such as, for example, a golf ball. Club head 100 and/or the face surface of face 107 can comprise a face center. Meanwhile, the face center of the face surface of face 107 can refer to a location at the face surface of face 107 that is equidistant between toe end 105 and heel end 106 and further that is equidistant between top end 101 and bottom end 102. In various examples, the face center can refer to the face center as defined at *United States Golf Association: Procedure for Measuring the Flexibility of a Golf Clubhead*, USGA-TPX 3004, Revision 1.0.0, p. 6, May 1, 2008 (retrieved Sep. 18, 2013 from http://www.usga.org/equipment/ testing/protocols/Test-Protocols-For-Equipment), which is incorporated herein by reference. In many embodiments, face 107 (and/or face portion 113 as discussed below) can comprise one or more scoring lines (e.g., grooves). The scoring line(s) can extend between toe end 105 and heel end 106.

Further, club head 100 can comprise a heel-toe axis and a front-rear axis. The heel-toe axis of club head 100 can refer to a reference axis extending between toe end 105 and heel end 106, and the front-rear axis of club head 100 can refer to a reference axis extending between front end 103 and rear end 104. The heel-toe axis and front-rear axis of club head 100 can be approximately perpendicular to each other, and also can be approximately parallel to a ground plane when club head 100 is positioned in an address configuration. The address configuration can refer to a configuration of club head 100 in which club head 100 is positioned to address a golf ball (e.g., by a user as part of a golf club) while club head 100 is in a resting state. In other embodiments, the address configuration can refer to a configuration of club head 100 in which club head 100 is balanced (e.g., at sole 109) on a level surface (e.g., a ground surface) and acted upon only by gravity. In these or other embodiments, club head 100 can be decoupled from the shaft.

Also, club head 100 can comprise a loft plane. The loft plane can refer to a plane that intersects the face center of the face surface of face 107 and that is approximately parallel with face 107 when club head 100 is positioned in the address configuration. When face 107 is planar and/or substantially planar, face 107 and the loft plane can be approximately co-planar. Meanwhile, when face 107 is non-planar (e.g., curved), the loft plane can be tangent to the face center of face 107, and at least part of face 107 can be located in front of or behind the loft plane.

The hosel and the hosel transition portion of club head 100, or when applicable, the bore of club head 100, can be located at or proximate to heel end 106. In various embodiments, an opening of the bore of club head 100 can be located at or proximate to crown 108. Further, a hosel port can be located at or proximate to sole 109 and/or opposite the opening of the bore or an opening of the hosel. In embodiments where club head 100 comprises the hosel and/or the hosel transition portion, the bore can be omitted, and vice versa. The hosel port can be implemented with the hosel of club head 100, or when applicable, the bore of club head 100.

Meanwhile, although a shaft is not illustrated at the drawings, the hosel of club head 100, or when applicable, the bore of club head 100, can be configured to receive a shaft (i.e., via the opening of the hosel or the bore), such as, for example, a golf club shaft. Accordingly, the hosel or the bore can receive the shaft and permit the shaft to be coupled (e.g., permanently or removably) to club head 100 when the hosel or the bore receives the shaft. In some embodiments, the hosel or the bore can be further configured to couple the shaft to club head 100, such as, for example, via threaded coupling. Further or alternatively, and as applicable, a bolt can be implemented to couple the shaft to club head 100 at the hosel port, opposite of the opening of the hosel or the bore and towards sole 102. In these embodiments, the shaft, when received at the hosel or the bore, can pass through club head 100 to the hosel port.

Club head 100 can comprise one or more branding and/or other symbols, such as, for example, to indicate a manufacturer of club head 100. In other embodiments, the branding and/or other symbol(s) can be omitted.

In some embodiments, club head 100 can comprise a face portion 113 and a support body 114. As explained in detail below, various advantages of club head 100 can be provided by binding one or more characteristics (e.g., material characteristics) of face portion 113 to those corresponding characteristics of support body 114, and vice versa. For example, club head 100 can be configured so that a material characteristic (e.g., yield strength) of face portion 113 is approximately bound within a predetermined ratio (e.g., as a maximum ratio or minimum ratio) with a corresponding material characteristic (e.g., yield strength) of support body 114.

Focusing initially on face portion 113, face portion 113 can be implemented according to numerous embodiments. That is, face portion 113 can comprise some or all of face 107 in some embodiments, and moreover, can also be part of crown 108 and/or sole 109 in some of those embodiments when face portion 113 comprises all of face 107.

For example, in some embodiments, face portion 113 comprises face 107. In some of these embodiments, face portion 113 is face 107. However, as discussed previously, in further embodiments, face portion 113 can comprise more of club head 100 than face 107, such as, for example, a crown face portion, a sole face portion, and/or one or two skirt face portions. In these embodiments, as applicable, crown 108 comprises the crown face portion, sole 109 comprises the sole face portion, and the skirt comprises the skirt face portion(s). When implemented, the skirt face portions can comprise a toe end skirt face portion and/or a heel end skirt face portion. Generally, face portion 113 can comprise the skirt face portion(s) when the skirt face portion(s) are implemented and the skirt extends between crown 108 and sole 109 completely around to face 107 at toe end 105 and/or at heel end 106. In other embodiments, the crown face portion, the sole face portion, and/or the skirt face portion(s) can be omitted, such as, for example, when face portion 113 is face 107, and/or when face portion 113 comprises face insert 117, as discussed below. Generally, even though the crown face portion and/or sole face portion may be implemented, the skirt face portion(s) can be omitted when the the skirt extends between crown 108 and sole 109, but less than completely around to face 107 at toe end 105 and/or at heel end 106, thereby not interfacing with face 107. In other words, implementation of the crown face portion, sole face portion, and/or skirt face portion(s) can depend on whether and the manner in which face 107, crown 108, sole 109, and/or the skirt are implemented. In some embodiments, when face portion 113 comprises the crown face portion and the sole face portion (and the skirt face portions if applicable), face portion 113 can form a cup shape.

As illustrated at FIG. 1, in many embodiments, face portion 113 can comprise face insert 117. In these embodiments, face 107 can comprise face portion 113 and/or face insert 117. When face portion 113 comprises face insert 117, face insert 117 can comprise a strike plate of club head 100. Accordingly, when face portion 113 is limited to face insert 117, face portion 113 can comprise only a portion of face 107.

Meanwhile, in these embodiments, support body 114 also can comprise a face support body 118, which can comprise a remaining portion of face 107. In some embodiments, face support body 118 can comprise face support body top portion 119 and/or face support body bottom portion 120, and/or can comprise one or more other portions depending on the manner in which face insert 117 is implemented (e.g., the shape and/or size of face insert 117). In these embodiments, when applicable, face support body top portion 119, face support body bottom portion 120, etc. can be continuous or discontinuous with each other, again depending on the manner in which face insert 117 is implemented. Notably, in many embodiments, face support body 118 completely surrounds a perimeter edge 123 of face insert 117, thereby being completely continuous about face insert 117. Still, in other embodiments, face support body 118, face support body top portion 119, and/or face support body bottom portion 120 can be omitted, such as, for example, when face portion 113 is implemented such that face portion 113 does not comprise face insert 117.

Face insert 117 can comprise a front surface 121, a rear surface 222 (FIG. 2) opposite front surface 121, and perimeter edge 123. Meanwhile, in these embodiments, face support body 118 can comprise a front surface 124, a rear surface 225 (FIG. 2) opposite front surface 124, and a perimeter edge 126.

In these embodiments, face support body top portion 119 also can comprise a front surface 127, a rear surface 228 (FIG. 2) opposite front surface 127, and a perimeter edge 129; and/or face support body bottom portion 120 also can comprise a front surface 130, a rear surface 231 (FIG. 2) opposite front surface 130, and a perimeter edge 132. Meanwhile, front surface 124 of face support body 118 can comprise front surface 127 and/or front surface 130; rear surface 225 (FIG. 2) of face support body 118 can comprise rear surface 228 (FIG. 2) and/or rear surface 231 (FIG. 2); and perimeter edge 126 of face support body 118 can comprise perimeter edge 129 and/or perimeter edge 132.

Turning focus now to support body 114, in many embodiments, support body 114 can comprise a crown support body 115, a sole support body 116, and/or a skirt support body. In these embodiments, crown 108 comprises crown support body 115, sole 109 comprises sole support body 116, and/or the skirt comprises the skirt support body. In some embodiments, crown support body 115 is crown 108, sole support body 116 is sole 109, and/or the skirt support body is the skirt, such as, for example, when the crown face portion, the sole face portion, and/or the skirt face portions are omitted, respectively.

Club head 100 can be solid, hollow, or partially hollow. When club head 100 is hollow or partially hollow, support body 114 can comprise a support shell. When the support shell is coupled to face portion 113, as discussed below, face portion 113 and the support shell can provide and enclose or substantially enclose a void space of club head 100. In some embodiments, the void space can be empty, though in other embodiments, the void space can be filled and/or partially filled with a filler material different from a material of face portion 113 and/or the support shell. For example, the filler material can comprise plastic foam.

In many embodiments, face portion 113 can be coupled to support body 114. Face portion 113 can be coupled to support body 114 mechanically (e.g., via one or more coupling mechanisms and/or via a friction fit, etc.) and/or by bonding (e.g., via welding, via crimping, via brazing, via soldering, and/or via adhesive, etc.).

When face portion 113 is face 107, face portion 113 can be coupled to support body 114 at crown intersection 111, sole intersection 112, and/or when applicable, the intersection(s) of the skirt with face 107. Meanwhile, when face portion 113 comprises the crown face portion, the sole face portion, and/or the skirt face portion(s) (i.e., face portion 113 comprises more than face 107), face portion 113 can be coupled to support body 114 at the intersections of the crown face portion, the sole face portion, and/or the skirt face portion(s) with crown support body 115, sole support body 116, and/or the skirt support body, respectively. Further, when face portion 113 comprises face insert 117, perimeter edge 123 of face portion 113 can be coupled to perimeter edge 126 of support body 114. Although the foregoing may suggest the interface between face portion 113 and support body 114 is uniform (e.g., planar), in some embodiments, face portion 113 may comprise one or more face portions (e.g., the crown face portion, the sole face portion, and/or the skirt face portion(s), etc.) in the same embodiments in which support body 114 comprises one or more body portions (e.g., crown support body 115, sole support body 116, and/or skirt the support body, etc.) such that the interface between face portion 113 and support body 114 may be non-uniform (e.g., non-planar).

Meanwhile, when face portion 113 comprises face insert 117, perimeter edge 123 can substantially correspond in shape to perimeter edge 126. Although the shape of perimeter edge 123 and perimeter edge 126 can be any suitable shape. The shape can be regular or irregular. In specific examples, the shape can be (e.g., approximately) a circle, an ellipse, or a polygon. In many embodiments, the shape can be oblong and can comprise a major axis and minor axis. Generally, the major axis can be oriented in any suitable manner, though in many embodiments, the major axis can intersect the face center of the face surface of face 107. Further, the major axis can be oriented approximately parallel or orthogonal to the heel-toe axis of club head 100. However, in still other embodiments, the major axis can be oriented at an angle (e.g., a complimentary angle) with respect to the heel-toe axis of club head 100.

As discussed previously, the center of gravity and moment of inertia of club head 100 are functions of the distribution of mass of club head 100. By reducing a thickness of face 107 and/or face portion 113 (i.e., a mass of face 107 and/or face portion 113), additional mass can be distributed elsewhere at club head 100. For example, the mass savings of face 107 and/or face portion 113 can be distributed closer to sole 109, farther from face 107, and/or closer to toe end 105 and/or heel end 106, thereby altering the center of gravity and/or the moment of inertia of club head 100. Meanwhile, distributing such mass of club head 100 closer to sole 109 and/or farther from face 107 can increase a flight angle of a golf ball struck with club head 100, and, increasing the flight angle of a golf ball can increase the distance the golf ball travels after impact. Further, distributing the mass savings of face 107 and/or face portion 113 to be closer to toe end 105 and/or heel end 106 can affect the moment of inertia of club head 100, which can alter the forgiveness of club head 100.

Likewise, the coefficient of restitution of club head 100 can be a function of at least the flexibility of face 107 and/or face portion 113. By reducing a thickness of face 107 and/or face portion 113, the flexibility of face 107 and/or face portion 113 can be increased, thereby increasing the coefficient of restitution of club head 100. Increasing the coefficient of restitution of club head 100 can increase the distance a golf ball travels after impact.

Accordingly, it can be seen that reducing a thickness of face 107 and/or face portion 113 can advantageously improve the performance of club head 100. However, as a practical matter, the extent to which the thickness of face 107 and/or face portion 113 can be reduced can be constrained by a durability of face 107 and/or face portion 113. Specifically, as the thickness of face 107 and/or face portion 113 is reduced, the durability can also be reduced. Meanwhile, insufficient durability can result in plastic deformation, cracking, and failure of club head 100.

To offset a reduction in durability due to reducing a thickness of face 107 and/or face portion 113, one possible solution is to increase a strength (e.g., yield strength, ultimate strength, etc.) of club head 100, face 107, and/or face portion 113. Specifically, increasing the strength (e.g., yield strength, ultimate strength, etc.) of club head 100, face 107, and/or face portion 113 can permit additional reductions in the thickness of face 107 and/or face portion 113 before plastic deformation, cracking, and failure of club head 100 would result. In implementation, increasing the strength (e.g., yield strength, ultimate strength, etc.) of club head 100, face 107, and/or face portion 113 can be accomplished through material selection, heat treatment, and/or other manufacturing conditions. However, as a practical matter, using a higher strength (e.g., yield strength, ultimate strength, etc.) material for all of club head 100 may be impractical due to material and/or manufacturing costs. Accordingly, it may be desirable to use the higher strength (e.g., yield strength, ultimate strength, etc.) material only at face 107 and/or face portion 113 while using another material (e.g., with lower strength) for part or all of the remainder of club head 100 (e.g., support body 114), such as, for example, to reduce material and/or manufacturing costs. Nonetheless, where there is too great a difference in the strength (e.g., yield strength, ultimate strength, etc.) of the higher strength material and the other material, peak stresses can develop where face portion 113 couples and/or transitions to support body 114. These peak stresses can still lead to plastic deformation, cracking, and failure of club head 100, at least with repeated use.

One possible solution to bridge the strength (e.g., yield strength, ultimate strength, etc.) gap between the higher strength material and the other material is to thicken club head 100 and/or implement reinforcing structures (e.g., ribs) where face portion 113 couples and/or transitions to support body 114. Thickening club head 100 and/or implementing reinforcing structures (e.g., ribs) where face portion 113 couples and/or transitions to support body 114 can distribute stresses over more area and prevent the other material from yielding. Another possible solution is to constrain the difference in the strength (e.g., yield strength, ultimate strength, etc.) of the higher strength material and the other material. This latter solution can be advantageous compared to the former solution because thickening club head 100 and/or implementing reinforcing structures (e.g., ribs) where face portion 113 couples and/or transitions to support body 114 results in a reduced ability to distribute mass elsewhere at club head 100. Indeed, thickening club head 100 and/or implementing reinforcing structures (e.g., ribs) where face portion 113 couples and/or transitions to support body 114 may even offset the other mass saved by thinning face 107 and/or face portion 113. Accordingly, the latter approach can permit for increased ability to optimize the center of gravity and moment of inertia of club head 100 because the area of club head 100 where face portion 113 couples and/or transitions to support body 114 can require less mass. Further, by not thickening club head 100 and/or implementing reinforcing structures (e.g., ribs) where face portion 113 couples and/or transitions to support body 114, the flexibility of face 107 and/or face portion 113 can be greater.

Accordingly, face portion 113 can comprise a first material, and support body 114 can comprise a second material. The first material can comprise a hardness, yield strength, and/or ultimate strength of the first material, and the second material can comprise a hardness, yield strength, and/or ultimate strength of the second material. In many embodiments, the first material can differ from the second material. Likewise, the yield strength and/or ultimate strength of the first material can differ from the yield strength and/or ultimate strength of the second material, respectively.

In many embodiments, the yield strength of the first material can be greater than or equal to approximately 910.0 MegaPascals, greater than or equal to approximately 950 MegaPascals, greater than or equal to approximately 975 MegaPascals, greater than or equal to approximately 1000 MegaPascals, greater than or equal to approximately 1010 MegaPascals, greater than or equal to approximately 1020 MegaPascals, greater than or equal to approximately 1030 MegaPascals, greater than or equal to approximately 1034 MegaPascals, greater than or equal to approximately 1040 MegaPascals, greater than or equal to approximately 1050 MegaPascals, greater than or equal to approximately 1075 MegaPascals, greater than or equal to approximately 1100 MegaPascals, greater than or equal to 1125 MegaPascals, greater than or equal to approximately 1150 MegaPascals, greater than or equal to 1175 MegaPascals, greater than or equal to approximately 1200 MegaPascals, greater than or equal to approximately 1242 MegaPascals, greater than or equal to approximately 1378 MegaPascals, or greater than or equal to approximately 1720 MegaPascals. In some specific embodiments, the yield strength of the first material can be approximately 1172 MegaPascals or 1655 MegaPascals.

In some embodiments, the ultimate strength of the first material can be greater than or equal to approximately 1034 MegaPascals or 1770 MegaPascals and/or can be less than or equal to approximately 1275 MegaPascals or 2172 MegaPascals. In some specific embodiments, the ultimate strength can be approximately 1724 MegaPascals, 1896 MegaPascals, or 1979 MegaPascals.

In some embodiments, the yield strength of the second material can be greater than or equal to approximately 1103 MegaPascals. Further, the ultimate strength of the second material can be greater than or equal to approximately 1276 MegaPascals.

In many embodiments, the yield strength of the second material can be greater than or equal to approximately 275 MegaPascals, greater than or equal to approximately 344 MegaPascals, greater than or equal to approximately 551 MegaPascals, greater than or equal to approximately 689 MegaPascals, greater than or equal to approximately 700 MegaPascals, greater than or equal to approximately 758 MegaPascals, greater than or equal to approximately 792 MegaPascals, greater than or equal to approximately 828 MegaPascals, greater than or equal to approximately 835 MegaPascals, greater than or equal to approximately 850 MegaPascals, greater than or equal to approximately 860 MegaPascals, greater than or equal to approximately 870 MegaPascals, greater than or equal to approximately 880 MegaPascals, greater than or equal to approximately 890 MegaPascals, greater than or equal to approximately 900 MegaPascals, greater than or equal to approximately 910 MegaPascals, greater than or equal to approximately 920 MegaPascals, greater than or equal to approximately 930 MegaPascals, greater than or equal to approximately 940 MegaPascals, greater than or equal to approximately 950 MegaPascals, greater than or equal to approximately 975 MegaPascals, greater than or equal to approximately 1000 MegaPascals, greater than or equal to approximately 1025 MegaPascals, or greater than or equal to approximately 1050 MegaPascals.

Meanwhile, as introduced previously above, one or more characteristics of the first material can be bound to those corresponding characteristics of the second material, and vice versa. For example, in many embodiments, a yield strength ratio of the yield strength of the second material to the yield strength of the first material can be greater than or equal to approximately 0.50. In some embodiments, the yield strength ratio can be greater than or equal to approximately 0.63. In these or other embodiments, an ultimate strength ratio of the ultimate strength of the second material to the ultimate strength of the first material can be greater than or equal to approximately 0.50. In some embodiments, the ultimate strength ratio can be greater than or equal to approximately 0.63. In further embodiments, the ultimate strength can be greater than or equal to approximately 0.74. In these embodiments, the exemplary yield strengths and/or ultimate strengths provided would conform to the yield strength ratio and/or the ultimate strength ratio.

In other embodiments, the hardness of the first material can be greater than or equal to approximately 50 Rockwell Hardness Scale C (HRC) and/or can be less than or equal to approximately 56 HRC. In some embodiments, the ultimate strength can be approximately 52.5 HRC or 53.5 HRC.

In many embodiments, the first material can comprise iron and/or titanium. In some embodiments, the first material can comprise an iron alloy and/or a titanium alloy. In specific examples, the first material can comprise carpenter grade 455 steel, carpenter grade 475 steel, C300 steel, C350 steel, a Ni—Co—Cr steel alloy, a quench and tempered steel alloy, or 565 steel. In other specific examples, the first material can comprise Ti SSAT2041 titanium alloy, Ti SP700 titanium alloy, Ti 15-0-3 titanium alloy, Ti 15-5-3 titanium alloy, Ti 3-8-6-4-4 titanium alloy, Ti 10-2-3 titanium alloy, Ti 15-3-3-3 titanium alloy, Ti-6-6-2 titanium alloy, Ti-185 titanium alloy, Ti-9S titanium alloy, or any combination thereof. In many embodiments, the first material comprises a sheet material that is formed into the face portion 113. In other embodiments, the first material can comprise other metals, plastics or composite materials.

In some embodiments, the first material comprises C300 steel having approximately 18.0-19.0% nickel, approximately 8.5-9.5% cobalt, approximately 4.6-5.2% molybdenum, with the remaining alloy composition being iron and other trace elements including 0.5-0.8% titanium, 0.05-0.15% aluminum, less than approximately 0.5% chromium, less than approximately 0.5% copper, less than approximately 0.1% manganese, less than approximately 0.1% silicon, less than approximately 0.3% carbon, less than approximately 0.01% phosphorus, or less than approximately 0.01% sulfur. In these embodiments, the first yield strength can be greater than or equal to approximately 1700 MegaPascals. The first yield strength can vary or increase with different heat treatments. For example, the first yield strength is approximately 1848 MegaPascals when the face comprising C300 steel (or the club head having a face comprising C300 steel) is heat treated at 830 degrees Celsius for approximately 60 minutes, followed by a second heat treatment at 480 degrees Celsius for greater than or equal to approximately 4 hours. In other examples, the first yield strength for C300 steel can vary with different heat treat parameters.

In some embodiments, the first material comprises a heat treated carpenter grade 455 steel having approximately 11.0-12.5% chromium, approximately 7.5-9.5% nickel, approximately 1.5-2.5% copper, approximately 0.1-0.5% niobium+tantalum, with the remaining alloy composition being iron and other trace elements including less than or equal to 0.05% carbon, less than or equal to 0.50% silicon, less than or equal to 0.04% phosphorus, less than or equal to 0.03% sulfur, less than or equal to 0.50% molybdenum, and less than or equal to 0.50% manganese. In many embodiments, the first yield strength can be greater than or equal to approximately 1551 MegaPascals. The first yield strength can vary or increase with different heat treatments. For example, the first yield strength is approximately 1551 MegaPascals when the face comprising 455 carpenter grade steel (or the club head having a face comprising carpenter grade 455 steel) is heat treated at 830 degrees Celsius for approximately 60 minutes, followed by a second heat treatment at 524 degrees Celsius for greater than or equal to approximately 4 hours. In other examples, the first yield strength for carpenter grade 455 steel can vary with different heat treat parameters.

In some embodiments, the first material comprises a heat treated carpenter grade 475 steel having approximately 10.5-11.5% chromium, approximately 8.9-9.0% cobalt, approximately 7.5-9.5% nickel, approximately 4.5-5.5% molybdenum, approximately 1.0-1.5% aluminum, with the remaining alloy composition being iron and other trace elements including less than or equal to 0.015% carbon, less than or equal to 0.50% silicon, less than or equal to 0.015% phosphorus, less than or equal to 0.01% sulfur, and less than or equal to 0.50% manganese. In many embodiments, the first yield strength can be greater than or equal to approximately 1620 MegaPascals. The first yield strength can vary or increase with different heat treatments. For example, the first yield strength is approximately 1620 MegaPascals when the face comprising 475 carpenter grade steel (or the club head having a face comprising carpenter grade 475 steel) is heat treated at 1012 degrees Celsius for approximately 60 minutes, followed by a cryogenic freezing with liquid nitrogen at −73 degrees Celsius for approximately 8 hours, followed by a second heat treatment at 538 degrees Celsius for greater than or equal to approximately 4 hours. In other examples, the first yield strength for carpenter grade 475 steel can vary with different heat treat parameters.

In some embodiments, the first material comprises a heat treated C350 steel having approximately 11.0-13.0% cobalt, approximately 18.0-19.0% nickel, approximately 4.5-5.5% molybdenum, approximately 1.0-2.0% titanium, with the remaining alloy composition being iron and other trace elements including approximately 0.05-0.15% aluminum, less than or equal to 0.03% carbon, less than or equal to 0.01% phosphorus, less than or equal to 0.10% silicon, less than or equal to 0.50% copper, less than or equal to 0.10% manganese, less than or equal to 0.01% sulfur, and less than or equal to 0.50% chromium. In many embodiments, the first yield strength can be greater than or equal to approximately 2406 MegaPascals. The first yield strength can vary or increase with different heat treatments. For example, the first yield strength is approximately 2406 MegaPascals when the face comprising C350 steel (or the club head having a face comprising C350 steel) is heat treated at 830 degrees Celsius for approximately 60 minutes, followed by a second heat treatment at 512 degrees Celsius for greater than or equal to approximately 4 hours. In other examples, the first yield strength for C350 steel can vary with different heat treat parameters.

In some embodiments, the first material comprises a heat treated Ni—Co—Cr steel alloy having approximately 2.0-3.0% chromium, approximately 14.0-16.0% cobalt, approximately 10.0-12.0% nickel, approximately 1.0-2.0% molybdenum, with the remaining alloy composition being iron and other trace elements including less than or equal to 0.35% carbon. In many embodiments, the first yield strength can be greater than or equal to approximately 1896 MegaPascals. The first yield strength can vary or increase with different heat treatments. For example, the first yield strength is approximately 1896 MegaPascals when the face comprising the Ni—Co—Cr steel alloy (or the club head having a face comprising the Ni—Co—Cr steel alloy) is heat treated at 915 degrees Celsius for approximately 60 minutes, followed by a cryogenic freezing with liquid nitrogen at −73 degrees Celsius for approximately 1 hours, followed by a second heat treatment at 482 degrees Celsius for greater than or equal to approximately 6 hours. In other examples, the first yield strength for the Ni—Co—Cr steel alloy can vary with different heat treat parameters.

In some embodiments, the first material comprises a heat treated a Ni—Co—Cr steel alloy having approximately 2.0-3.0% chromium, approximately 15.0-16.5% cobalt, approximately 12.0-13.0% nickel, approximately 1.0-2.0% molybdenum, with the remaining alloy composition being iron and other trace elements including less than or equal to 0.4% carbon. In many embodiments, the first yield strength can be greater than or equal to approximately 2068 MegaPascals. The first yield strength can vary or increase with different heat treatments. For example, the first yield strength is approximately 2068 MegaPascals when the face comprising the Ni—Co—Cr steel alloy (or the club head having a face comprising the Ni—Co—Cr steel alloy) is heat treated at 968 degrees Celsius for approximately 60 minutes, followed by a cryogenic freezing with liquid nitrogen at −73 degrees Celsius for approximately 1 hours, followed by a second heat treatment at 482 degrees Celsius for greater than or equal to approximately 2.5 hours, followed by a cryogenic freezing with liquid nitrogen at −73 degrees Celsius for approximately 1 hours, followed by a third heat treatment at 482 degrees Celsius for greater than or equal to 2.5 hours, followed by a cryogenic freezing with liquid nitrogen at −73 degrees Celsius for approximately 1 hour. In other examples, the first yield strength for the Ni—Co—Cr steel alloy can vary with different heat treat parameters.

In some embodiments, the first material comprises a 565 steel having approximately 11.0-12.5% chromium, approximately 1.0-2.0% cobalt, approximately 11.0-12.5% nickel, approximately 0.5-1.5% molybdenum, approximately 1.5-2.5% titanium, with the remaining alloy composition being iron and other trace elements including less than or equal to 0.05% carbon, less than or equal to 0.04% phosphorus, less than or equal to 0.03% sulfur, and less than or equal to 0.5% aluminum. In many embodiments, the first yield strength can be greater than or equal to approximately 1827 MegaPascals without requiring a heat treatment.

In some embodiments, the first material comprises a heat treated Ti SSAT2041 titanium alloy having approximately 21.0-23.0% vanadium, approximately 3.5-4.5% aluminum, approximately 0.5-1.5% tin, with the remaining alloy composition being titanium and other trace elements including less than or equal to 0.05% carbon, less than or equal to 1.0% silicon, less than or equal to 1.0% molybdenum, and less than or equal to 0.50% iron. In many embodiments, the first yield strength can be greater than or equal to approximately 1103 MegaPascals. The first yield strength can vary or increase with different heat treatments. For example, the first yield strength is approximately 1103 MegaPascals when the face comprising Ti SSAT2041 titanium alloy (or the club head having a face comprising Ti SSAT2041 titanium alloy) is heat treated at 800 degrees Celsius for approximately 30 minutes, followed by a second heat treatment at 480 degrees Celsius for greater than or equal to approximately 6.5 hours. In other examples, the first yield strength for Ti SSAT2041 titanium alloy can vary with different heat treat parameters.

In some embodiments, the first material comprises a Ti SP700 titanium alloy having approximately 4.0-5.0% aluminum, approximately 2.5-3.5% vanadium, approximately 1.8-2.2% molybdenum, approximately 1.7-2.3% iron, with the remaining alloy composition being titanium and other trace elements including less than or equal to 0.15% oxygen, less than or equal to 0.08%, carbon, less than or equal to 0.05% nitrogen, less than or equal to 0.015% hydrogen, and less than or equal to 0.005% yttrium. In many embodiments, the first yield strength can be approximately 1000 MegaPascals without requiring a heat treatment.

In some embodiments, the first material comprises a heat treated Ti 15-5-3 titanium alloy having approximately 15% molybdenum, approximately 5% zirconium, approximately 3% aluminum, with the remaining alloy composition being titanium and other trace elements. In many embodiments, the first yield strength can be greater than or equal to approximately 1303 MegaPascals. The first yield strength can vary or increase with different heat treatments. For example, the first yield strength is approximately 1303 MegaPascals when the face comprising Ti 15-5-3 titanium alloy (or the club head having a face comprising Ti 15-5-3 titanium alloy) is heat treated at 850 degrees Celsius for approximately 30 minutes, followed by a second heat treatment at 500 degrees Celsius for greater than or equal to approximately 6 hours. In other examples, the first yield strength for Ti 15-5-3 titanium alloy can vary with different heat treat parameters.

In some embodiments, the first material comprises a heat treated Ti 3-8-6-4-4 titanium alloy having approximately 7.5-8.5% vanadium, approximately 5.5-6.5% chromium, approximately 3.5-4.5% molybdenum, approximately 3.5-4.5% xirconium, approximately 3.0-4.0% aluminum, with the remaining alloy composition being titanium and other trace elements including less than or equal to 0.05% carbon, less than or equal to 0.03% iron, less than or equal to 0.03% nitrogen, and less than or equal to 0.14% oxygen. In many embodiments, the first yield strength can be greater than or equal to approximately 1276 MegaPascals. The first yield strength can vary or increase with different heat treatments. For example, the first yield strength is approximately 1276 MegaPascals when the face comprising Ti 3-8-6-4-4 titanium alloy (or the club head having a face comprising Ti 3-8-6-4-4 titanium alloy) is heat treated at 900 degrees Celsius for approximately 30 minutes, followed by a second heat treatment at 480 degrees Celsius for greater than or equal to approximately 16 hours. In other examples, the first yield strength for Ti 3-8-6-4-4 titanium alloy can vary with different heat treat parameters.

In some embodiments, the first material comprises a heat treated Ti 10-2-3 titanium alloy having approximately 9.0-11.0% vanadium, approximately 2.6-3.4% aluminum, approximately 1.6-2.2% iron, with the remaining composition being titanium and other trace elements including less than or equal to 0.05% carbon, less than or equal to 0.015% hydrogen, less than or equal to 0.05% nitrogen, and less than or equal to 0.13% oxygen. In many embodiments, the first yield strength can be greater than or equal to approximately 1241 MegaPascals. The first yield strength can vary or increase with different heat treatments. For example, the first yield strength is approximately 1241 MegaPascals when the face comprising Ti 10-2-3 titanium alloy (or the club head having a face comprising Ti 10-2-3 titanium alloy) is heat treated at 760 degrees Celsius for approximately 30 minutes, followed by a second heat treatment at 385 degrees Celsius for greater than or equal to approximately 8 hours. In other examples, the first yield strength for Ti 10-2-3 titanium alloy can vary with different heat treat parameters.

In some embodiments, the first material comprises a heat treated Ti 15-3-3-3 titanium alloy having approximately 14-16% vanadium, approximately 2.5-3.5% aluminum, approximately 2.5-3.5% chromium, approximately 2.5-3.5% tin, with the remaining alloy composition being titanium and other trace elements including less than or equal to 0.05% carbon, less than or equal to 0.015% hydrogen 2, less than or equal to 0.25% iron, less than or equal to 0.05% nitrogen, and less than or equal to 0.13% oxygen. In many embodiments, the first yield strength can be greater than or equal to approximately 1103 MegaPascals. The first yield strength can vary or increase with different heat treatments. For example, the first yield strength is approximately 1103 MegaPascals when the face comprising Ti 15-3-3-3 titanium alloy (or the club head having a face comprising Ti 15-3-3-3 titanium alloy) is heat treated at 790 degrees Celsius for approximately 30 minutes, followed by a second heat treatment at 480 degrees Celsius for greater than or equal to approximately 8 hours. In other examples, the first yield strength for Ti 15-3-3-3 titanium alloy can vary with different heat treat parameters.

In some embodiments, the first material comprises a heat treated Ti-9S titanium alloy having approximately 6.5-8.5% aluminum, approximately 1-2% vanadium, with the remaining alloy composition being titanium and other trace elements including less than or equal to 0.08% carbon, less than or equal to 0.2% silicon, less than or equal to 0.3% iron, less than or equal to 0.2% oxygen, and less than or equal to 0.05% nitrogen. In many embodiments, the first yield strength can be greater than or equal to approximately 965 MegaPascals. The first yield strength can vary or increase with different heat treatments. For example, the first yield strength is approximately 965 MegaPascals when the face comprising Ti-9S titanium alloy (or the club head having a face comprising Ti-9S titanium alloy) is heat treated at 600 degrees Celsius for approximately 60 minutes. In other examples, the first yield strength for Ti-9S titanium alloy can vary with different heat treat parameters.

In some embodiments, the first material comprises a heat treated Ti 6-6-2 titanium alloy having approximately 6.0% vanadium, approximately 6.0% aluminum, approximately 2.0% tin, with the remaining alloy composition being titanium and other trace elements including less than or equal to 0.5% copper, and less than or equal to 0.5% iron. In many embodiments, the first yield strength can be greater than or equal to approximately 1110 MegaPascals. The first yield strength can vary or increase with different heat treatments. For example, the first yield strength is approximately 1110 MegaPascals when the face comprising Ti-9S titanium alloy (or the club head having a face comprising Ti-9S titanium alloy) is heat treated at 900 degrees Celsius for approximately 30 minutes, followed by a water quench, followed by a second heat treatment at 500 degrees Celsius for greater than or equal to approximately 6 hours. In other examples, the first yield strength for Ti-9S titanium alloy can vary with different heat treat parameters.

In some embodiments, the first material comprises a heat treated Ti-185 titanium alloy having approximately 7.5-8.5% vanadium, approximately 0.8-1.5% aluminum, approximately 4.0-6.0% iron, with the remaining alloy composition being titanium and other trace elements including less than or equal to 0.07% nitrogen, less than or equal to 0.05% carbon, between 0.25-0.50% oxygen, and between 0.80-1.5% aluminum. In many embodiments, the first yield strength can be greater than or equal to approximately 1227 MegaPascals. The first yield strength can vary or increase with different heat treatments. For example, the first yield strength is approximately 1227 MegaPascals when the face comprising Ti-185 titanium alloy (or the club head having a face comprising Ti-185 titanium alloy) is heat treated at 675 degrees Celsius for approximately 30 minutes. For further example, the first yield strength is approximately 1448 MegaPascals when the face comprising Ti-185 titanium alloy (or the club head having a face comprising Ti-185 titanium alloy) is heat treated at 704 degrees Celsius for approximately 60 minutes, followed by a second heat treatment at 482 degrees Celsius for greater than or equal to approximately 26 hours. In other examples, the first yield strength for Ti-185 titanium alloy can vary with different heat treat parameters.

In some embodiments, the first material comprises a heat treated 17-4 steel alloy having approximately 15.0-17.5% chromium, approximately 3.0-5.0% nickel, approximately 2.8-3.5% copper, with the remaining alloy composition being iron and other trace elements including approximately 0.15-0.45% niobium, less than or equal to 0.07% carbon, less than or equal to 1.0% manganese, less than or equal to 0.5% molybdenum, less than or equal to 0.05% nitrogen, less than or equal to 0.05% oxygen, less than or equal to 0.04% phosphorus, less than or equal to 0.03% sulfur, and less than or equal to 1.0% silicon. In many embodiments, the first yield strength can be greater than or equal to approximately 1227 MegaPascals. The first yield strength can vary or increase with different heat treatments. For example, the first yield strength is approximately 1227 MegaPascals when the face comprising 17-4 steel alloy (or the club head having a face comprising 17-4 steel alloy) is heat treated at 1040 degrees Celsius for approximately 90 minutes, followed by a second heat treatment at 482 degrees Celsius for greater than or equal to approximately 4 hours. In other examples, the first yield strength for 17-4 steel alloy can vary with different heat treat parameters.

In some embodiments, the first material comprises a quench and tempered steel alloy having approximately 3.0-4.5% nickel, approximately 1.0-2.0% silicon, approximately 0.75-1.5% chromium, less than approximately 1.0% copper, less than approximately 1.25% manganese, less than approximately 1.0% molybdenum, less than approximately 0.75% vanadium, with the remaining alloy composition being iron and other trace elements. In many embodiments, the first yield strength can be greater than or equal to approximately 1655 MegaPascals. The first yield strength can vary or increase with different heat treatments. For example, the first yield strength is approximately 1655 MegaPascals when the face comprising the quench and tempered steel alloy (or the club head having a face comprising the quench and tempered steel alloy) is heat treated at 918 degrees Celsius for approximately 60 minutes, followed by nitrogen cooling and a cryogenic freezing at −73 degrees Celsius for approximately 8 hours, followed by a heat treatment at 260 degrees Celsius for approximately 2 hours. In other examples, the first yield strength for the quench and tempered steel alloy can vary with different heat treat parameters.

In many embodiments, the second material can comprise iron and/or titanium. In some embodiments, the second material can comprise an iron alloy and/or a titanium alloy. In specific examples, the second material can comprise heat treated 17-4 stainless steel, 431SS steel, 8620 steel, 1020 steel, a quench and tempered steel alloy, 1025 steel, C300 steel, C350 steel, a Ni—Co—Cr steel alloy, or 565 steel. In other specific examples, the second material can comprise Ti 6-4 titanium alloy, Ti 811 titanium alloy, or Ti 9S titanium alloy or any combination thereof. In many embodiments the second material comprises a casted material. In other embodiments, the first material can comprise other metals, plastics or composite materials.

In some embodiments, the second material comprises a Ti 811 titanium alloy having approximately 7.35-8.35% aluminum, approximately 0.75-1.25% vanadium, approximately 0.75-1.25% molybdenum, with the remaining alloy composition being titanium and other trace elements including less than or equal to 0.3% iron, less than or equal to 0.08% carbon, less than or equal to 0.05% nitrogen, less than or equal to 0.015% hydrogen, and less than or equal to 0.12% oxygen. In many embodiments, the first yield strength can be approximately 779 MegaPascals without requiring a heat treatment.

In some embodiments, the second material comprises a heat treated 431SS steel alloy having approximately 15.0-17.0% chromium, approximately 1.5-2.2% nickel, with the remaining alloy composition being iron and other trace elements including approximately 0.06-1.0% carbon, less than or equal to 1.0% silicon, less than or equal to 1.0% manganese, less than or equal to 0.04% phosphorus, less than or equal to 0.04% sulfur, and less than or equal to 0.5% nitrogen. In many embodiments, the second yield strength can be greater than or equal to approximately 724 MegaPascals. The second yield strength can vary or increase with different heat treatments. For example, the second yield strength is approximately 724 MegaPascals when the body comprising 431SS steel alloy (or the club head having a body comprising 431SS steel alloy) is heat treated at 1040 degrees Celsius for approximately 90 minutes, followed by a second heat treatment at 590 degrees Celsius for greater than or equal to approximately 1.5 hours. In other examples, the second yield strength for 431SS steel alloy can vary with different heat treat parameters.

In some embodiments, the second material comprises C300 steel having approximately 18.0-19.0% nickel, approximately 8.5-9.5% cobalt, approximately 4.6-5.2% molybdenum, with the remaining alloy composition being iron and other trace elements including 0.5-0.8% titanium, 0.05-0.15% aluminum, less than approximately 0.5% chromium, less than approximately 0.5% copper, less than approximately 0.1% manganese, less than approximately 0.1% silicon, less than approximately 0.3% carbon, less than approximately 0.01% phosphorus, or less than approximately 0.01% sulfur. In these embodiments, the second yield strength can be greater than or equal to approximately 1478 MegaPascals. The second yield strength can vary or increase with different heat treatments. For example, the second yield strength is approximately 1478-1663 MegaPascals when the body comprising C300 steel (or the club head having a body comprising C300 steel) is heat treated at 830 degrees Celsius for approximately 60 minutes, followed by a second heat treatment at 480 degrees Celsius for greater than or equal to approximately 4 hours. In other examples, the second yield strength for C300 steel can vary with different heat treat parameters.

In some embodiments, the second material comprises a heat treated C350 steel having approximately 11.0-13.0% cobalt, approximately 18.0-19.0% nickel, approximately 4.5-5.5% molybdenum, approximately 1.0-2.0% titanium, with the remaining alloy composition being iron and other trace elements including approximately 0.05-0.15% aluminum, less than or equal to 0.03% carbon, less than or equal to 0.01% phosphorus, less than or equal to 0.10% silicon, less than or equal to 0.50% copper, less than or equal to 0.10% manganese, less than or equal to 0.01% sulfur, and less than or equal to 0.50% chromium. In many embodiments, the second yield strength can be greater than or equal to approximately 1925 MegaPascals. The second yield strength can vary or increase with different heat treatments. For example, the second yield strength is approximately 1925-2166 MegaPascals when the body comprising C350 steel (or the club head having a body comprising C350 steel) is heat treated at 830 degrees Celsius for approximately 60 minutes, followed by a second heat treatment at 512 degrees Celsius for greater than or equal to approximately 4 hours. In other examples, the second yield strength for C350 steel can vary with different heat treat parameters.

In some embodiments, the second material comprises a heat treated Ni—Co—Cr steel alloy having approximately 2.0-3.0% chromium, approximately 14.0-16.0% cobalt, approximately 10.0-12.0% nickel, approximately 1.0-2.0% molybdenum, with the remaining alloy composition being iron and other trace elements including less than or equal to 0.35% carbon. In many embodiments, the second yield strength can be greater than or equal to approximately 1517 MegaPascals. The second yield strength can vary or increase with different heat treatments. For example, the second yield strength is approximately 1517-1706 MegaPascals when the body comprising the Ni—Co—Cr steel alloy (or the club head having a body comprising the Ni—Co—Cr steel alloy) is heat treated at 915 degrees Celsius for approximately 60 minutes, followed by a cryogenic freezing with liquid nitrogen at −73 degrees Celsius for approximately 1 hours, followed by a second heat treatment at 482 degrees Celsius for greater than or equal to approximately 6 hours. In other examples, the second yield strength for the Ni—Co—Cr steel alloy can vary with different heat treat parameters.

In some embodiments, the second material comprises a heat treated a Ni—Co—Cr steel alloy having approximately 2.0-3.0% chromium, approximately 15.0-16.5% cobalt, approximately 12.0-13.0% nickel, approximately 1.0-2.0% molybdenum, with the remaining alloy composition being iron and other trace elements including less than or equal to 0.4% carbon. In many embodiments, the second yield strength can be greater than or equal to approximately 1655 MegaPascals. The second yield strength can vary or increase with different heat treatments. For example, the second yield strength is approximately 1655-1862 MegaPascals when the body comprising the Ni—Co—Cr steel alloy (or the club head having a body comprising the Ni—Co—Cr steel alloy) is heat treated at 968 degrees Celsius for approximately 60 minutes, followed by a cryogenic freezing with liquid nitrogen at −73 degrees Celsius for approximately 1 hours, followed by a second heat treatment at 482 degrees Celsius for greater than or equal to approximately 2.5 hours, followed by a cryogenic freezing with liquid nitrogen at −73 degrees Celsius for approximately 1 hours, followed by a third heat treatment at 482 degrees Celsius for greater than or equal to 2.5 hours, followed by a cryogenic freezing with liquid nitrogen at −73 degrees Celsius for approximately 1 hour. In other examples, the second yield strength for the Ni—Co—Cr steel alloy can vary with different heat treat parameters.

In some embodiments, the second material comprises a 565 steel having approximately 11.0-12.5% chromium, approximately 1.0-2.0% cobalt, approximately 11.0-12.5% nickel, approximately 0.5-1.5% molybdenum, approximately 1.5-2.5% titanium, with the remaining alloy composition being iron and other trace elements including less than or equal to 0.05% carbon, less than or equal to 0.04% phosphorus, less than or equal to 0.03% sulfur, and less than or equal to 0.5% aluminum. In many embodiments, the second yield strength can be greater than or equal to approximately 1462 MegaPascals without requiring a heat treatment.

In some embodiments, the second material comprises a quench and tempered steel alloy having approximately 3.0-4.5% nickel, approximately 1.0-2.0% silicon, approximately 0.75-1.5% chromium, less than approximately 1.0% copper, less than approximately 1.25% manganese, less than approximately 1.0% molybdenum, less than approximately 0.75% vanadium, with the remaining alloy composition being iron and other trace elements. In many embodiments, the second yield strength can be greater than or equal to approximately 1517 MegaPascals. The second yield strength can vary or increase with different heat treatments. For example, the second yield strength is approximately 1517 MegaPascals when the body comprising the quench and tempered steel alloy (or the club head having a body comprising the quench and tempered steel alloy) is heat treated at 918 degrees Celsius for approximately 60 minutes, followed by nitrogen cooling and a cryogenic freezing at −73 degrees Celsius for approximately 8 hours, followed by a heat treatment at 260 degrees Celsius for approximately 2 hours. In other examples, the second yield strength for the quench and tempered steel alloy can vary with different heat treat parameters.

In some embodiments, the second material comprises a heat treated 17-4 stainless steel having approximately 15.0-17.5% chromium, approximately 3.0-5.0% nickel, approximately 2.8-3.5% copper, with the remaining alloy composition being iron and other trace elements including approximately 0.15-0.45% niobium, less than or equal to 0.07% carbon, less than or equal to 1.0% manganese, less than or equal to 0.5% molybdenum, less than or equal to 0.05% nitrogen, less than or equal to 0.05% oxygen, less than or equal to 0.04% phosphorus, less than or equal to 0.03% sulfur, and less than or equal to 1.0% silicon. In these embodiments, the second yield strength can range from approximately 1000 MegaPascals to approximately 1400 MegaPascals. The second yield strength can vary or increase with different heat treatments. For example, the second yield strength can be approximately 1027 MegaPascals when the body made of 17-4 stainless steel (or the club head having a body made of 17-4 stainless steel) is heat treated at 830 degrees Celsius for approximately 60 minutes and cooled in nitrogen gas, followed by a second heat treatment at 480 degrees Celsius for greater than or equal to approximately 4 hours and cooled in air. For further example, the second yield strength can be approximately 1138 MegaPascals when the body made of 17-4 stainless steel (or the club head having a body made of 17-4 stainless steel) is heat treated at 1040 degrees Celsius for approximately 90 minutes and cooled in nitrogen gas, followed by a second heat treatment at 482 degrees Celsius for greater than or equal to approximately 4 hours and cooled in air.

For further example, in other examples, the second yield strength can be approximately 1169 MegaPascals when the body made of 17-4 stainless steel (or the club head having a body made of 17-4 stainless steel) is heat treated at 1040 degrees Celsius for approximately 90 minutes and cooled in nitrogen gas, followed by a second heat treatment at 830 degrees Celcius for approximately 60 minutes and cooled in nitrogen gas, followed by a third heat treatment at 480 degrees Celsius for greater than or equal to approximately 4 hours and cooled in air. Further still, the second yield strength can be approximately 1069 MegaPascals when the body made of 17-4 stainless steel (or the club head having a body made of 17-4 stainless steel) is heat treated at 1040 degrees Celsius for approximately 90 minutes and cooled in nitrogen gas, followed by a second heat treatment at 830 degrees Celsius for approximately 60 minutes and cooled in nitrogen gas, followed by a third heat treatment at 524 degrees Celsius for greater than or equal to approximately 4 hours and cooled in air. Further still, the second yield strength can be approximately 1034 MegaPascals when the body made of 17-4 stainless steel (or the club head having a body made of 17-4 stainless steel) is heat treated at 1040 degrees Celsius for approximately 90 minutes and cooled in nitrogen gas, followed by a second heat treatment at 1012 degrees Celsius for approximately 60 minutes, followed by a cryogenic freezing with liquid nitrogen at −73 degrees Celsius for approximately 8 hours, followed by a third heat treatment at 538 degrees Celsius for greater than or equal to approximately 4 hours and cooled in air. In these examples, the first heat treatment can be performed on the body 114 of the club head 100, while the second and third heat treatments can be performed on the club head 100 having the body 114 and face portion 113, thereby increasing the second yield strength as a result of the addition of the first heat treatment, without affecting the first yield strength or other properties of the first material. In other embodiments, the temperatures and durations of the first, second, and third heat treatments can vary to further increase the yield strength of the second material. Further, in other embodiments, each of the first, the second, or the third heat treatment can be performed on any portion of the club head, such as the body, the face, or a combination of the body and the face.

For example, in many embodiments, the club head having the face portion 113 and the body 114 undergoes the same heat treatment(s). In some embodiments, the body 114 of the club head undergoes one or more heat treatments and the club head having the face portion 113 and body 114 subsequently undergoes additional heat treatment(s). In other embodiments, the face portion 113 can undergo one or more heat treatments and the club head having the face portion 113 and body 114 can subsequently undergo additional heat treatment(s). Further, in other embodiments, the face portion 113 comprising the first material can undergo one or more heat treatments separate from the body 114, the body 114 comprising the second material can undergo one or more heat treatments separate from the face portion 113, the face portion 113 and the body 114 can simultaneously undergo one or more heat treatments, or the club head can undergo any combination of the above described heat treatment processes.

Various combinations of first and second materials, as described above, can be used to achieve a high strength face while maintaining sufficient body strength to prevent peak stresses from leading to plastic deformation, cracking, or failure of club head 100 with repeated use. In one example, the first material of the club head 1000 can comprise C300 steel having a first yield strength of approximately 1848 MegaPascals and the second material can comprise 17-4 stainless steel having a second yield strength of approximately 1169 MegaPascals, such that the yield strength ratio is approximately 0.63. In this or other examples, the club head 100 undergoes one or more heat treatments comprising: a first heat treatment on the body 114 to a temperature of approximately 1040 degrees Celsius for approximately 90 minutes followed by cooling in nitrogen gas, a second heat treatment on the club head 100 (with the face portion 113 attached) to a temperature of approximately 830 degrees Celcius for approximately 60 minutes followed by cooling in nitrogen gas, and a third heat treatment on the club head 100 (with the face portion 113 attached) to a temperature of approximately 480 degrees Celsius for greater than or equal to approximately 4 hours followed by cooling in air, to achieve the above described yield strengths.

In other examples of a club head having a first material comprising C300 steel and a second material comprising 17-4 stainless steel, the yield strengths and yield strength ratio can vary with different heat treat parameters.

In another example, the first material of the club head 1000 can comprise carpenter grade 455 steel having a first yield strength of approximately 1551 MegaPascals and the second material can comprise 17-4 stainless steel having a second yield strength of approximately 1138 MegaPascals, such that the yield strength ratio is approximately 0.73. In this example, various heat treatments can be used to further increase the yield strengths and the yield strength ratio.

In yet another example, the first material of the club head 1000 can comprise carpenter grade 475 steel having a first yield strength of approximately 1620 MegaPascals and the second material can comprise 17-4 stainless steel having a second yield strength of approximately 1138 MegaPascals, such that the yield strength ratio is approximately 0.70. In this example, various heat treatments can be used to further increase the yield strengths and the yield strength ratio.

In yet another example, the first material of the club head 1000 can comprise C300 steel having a first yield strength of approximately 1848 MegaPascals and the second material can comprise 17-4 stainless steel having a second yield strength of approximately 1138 MegaPascals, such that the yield strength ratio is approximately 0.62. In this example, various heat treatments can be used to further increase the yield strengths and the yield strength ratio.

In yet another example, the first material of the club head 1000 can comprise A Ni—Co—Cr steel alloy having a first yield strength of approximately 1896 MegaPascals and the second material can comprise 17-4 stainless steel having a second yield strength of approximately 1138 MegaPascals, such that the yield strength ratio is approximately 0.60. In this example, various heat treatments can be used to further increase the yield strengths and the yield strength ratio.

In yet another example, the first material of the club head 1000 can comprise a Ni—Co—Cr steel alloy having a first yield strength of approximately 2068 MegaPascals and the second material can comprise 17-4 stainless steel having a second yield strength of approximately 1138 MegaPascals, such that the yield strength ratio is approximately 0.55. In this example, various heat treatments can be used to further increase the yield strengths and the yield strength ratio.

In yet another example, the first material of the club head 1000 can comprise 565 steel having a first yield strength of approximately 1827 MegaPascals and the second material can comprise 17-4 stainless steel having a second yield strength of approximately 1138 MegaPascals, such that the yield strength ratio is approximately 0.62. In this example, various heat treatments can be used to further increase the yield strengths and the yield strength ratio.

In yet another example, the first material of the club head 1000 can comprise Ti SSAT2041 titanium alloy having a first yield strength of approximately 1103 MegaPascals and the second material can comprise 17-4 stainless steel having a second yield strength of approximately 1138 MegaPascals, such that the yield strength ratio is approximately 1.03. In this example, various heat treatments can be used to further increase the yield strengths and the yield strength ratio.

In yet another example, the first material of the club head 1000 can comprise Ti 15-5-3 titanium alloy having a first yield strength of approximately 1303 MegaPascals and the second material can comprise 17-4 stainless steel having a second yield strength of approximately 1138 MegaPascals, such that the yield strength ratio is approximately 0.87. In this example, various heat treatments can be used to further increase the yield strengths and the yield strength ratio.

In yet another example, the first material of the club head 1000 can comprise Ti 3-8-6-4-4 titanium alloy having a first yield strength of approximately 1276 MegaPascals and the second material can comprise 17-4 stainless steel having a second yield strength of approximately 1138 MegaPascals, such that the yield strength ratio is approximately 0.89. In this example, various heat treatments can be used to further increase the yield strengths and the yield strength ratio.

In yet another example, the first material of the club head 1000 can comprise Ti 10-2-3 titanium alloy having a first yield strength of approximately 1241 MegaPascals and the second material can comprise 17-4 stainless steel having a second yield strength of approximately 1138 MegaPascals, such that the yield strength ratio is approximately 0.92. In this example, various heat treatments can be used to further increase the yield strengths and the yield strength ratio.

In yet another example, the first material of the club head 1000 can comprise Ti 15-3-3-3 titanium alloy having a first yield strength of approximately 1103 MegaPascals and the second material can comprise 17-4 stainless steel having a second yield strength of approximately 1138 MegaPascals, such that the yield strength ratio is approximately 1.03. In this example, various heat treatments can be used to further increase the yield strengths and the yield strength ratio.

In yet another example, the first material of the club head 1000 can comprise Ti-9S titanium alloy having a first yield strength of approximately 965 MegaPascals and the second material can comprise 17-4 stainless steel having a second yield strength of approximately 1138 MegaPascals, such that the yield strength ratio is approximately 1.18. In this example, various heat treatments can be used to further increase the yield strengths and the yield strength ratio.

In yet another example, the first material of the club head 1000 can comprise Ti 6-6-2 titanium alloy having a first yield strength of approximately 1110 MegaPascals and the second material can comprise 17-4 stainless steel having a second yield strength of approximately 1138 MegaPascals, such that the yield strength ratio is approximately 1.03. In this example, various heat treatments can be used to further increase the yield strengths and the yield strength ratio.

In yet another example, the first material of the club head 1000 can comprise Ti-185 titanium alloy having a first yield strength of approximately 1448 MegaPascals and the second material can comprise 17-4 stainless steel having a second yield strength of approximately 1138 MegaPascals, such that the yield strength ratio is approximately 0.79. In this example, various heat treatments can be used to further increase the yield strengths and the yield strength ratio.

In yet another example, the first material of the club head 1000 can comprise a sheet 17-4 stainless steel having a first yield strength of approximately 1227 MegaPascals and the second material can comprise a cast 17-4 stainless steel having a second yield strength of approximately 1138 MegaPascals, such that the yield strength ratio is approximately 0.93. In this example, various heat treatments can be used to further increase the yield strengths and the yield strength ratio.

In yet another example, the first material of the club head 1000 can comprise Ti SSAT2041 titanium alloy having a first yield strength of approximately 1103 MegaPascals and the second material can comprise 431SS steel alloy having a second yield strength of approximately 724 MegaPascals, such that the yield strength ratio is approximately 0.66. In this example, various heat treatments can be used to further increase the yield strengths and the yield strength ratio.

In yet another example, the first material of the club head 1000 can comprise Ti 15-5-3 titanium alloy having a first yield strength of approximately 1303 MegaPascals and the second material can comprise 431SS steel alloy having a second yield strength of approximately 724 MegaPascals, such that the yield strength ratio is approximately 0.56. In this example, various heat treatments can be used to further increase the yield strengths and the yield strength ratio.

In yet another example, the first material of the club head 1000 can comprise Ti 3-8-6-4-4 titanium alloy having a first yield strength of approximately 1276 MegaPascals and the second material can comprise 431SS steel alloy having a second yield strength of approximately 724 MegaPascals, such that the yield strength ratio is approximately 0.57. In this example, various heat treatments can be used to further increase the yield strengths and the yield strength ratio.

In yet another example, the first material of the club head 1000 can comprise Ti 10-2-3 titanium alloy having a first yield strength of approximately 1241 MegaPascals and the second material can comprise 431SS steel alloy having a second yield strength of approximately 724 MegaPascals, such that the yield strength ratio is approximately 0.58. In this example, various heat treatments can be used to further increase the yield strengths and the yield strength ratio.

In yet another example, the first material of the club head 1000 can comprise Ti 15-3-3-3 titanium alloy having a first yield strength of approximately 1103 MegaPascals and the second material can comprise 431SS steel alloy having a second yield strength of approximately 724 MegaPascals, such that the yield strength ratio is approximately 0.66. In this example, various heat treatments can be used to further increase the yield strengths and the yield strength ratio.

In yet another example, the first material of the club head 1000 can comprise Ti-9S titanium alloy having a first yield strength of approximately 965 MegaPascals and the second material can comprise 431SS steel alloy having a second yield strength of approximately 724 MegaPascals, such that the yield strength ratio is approximately 0.75. In this example, various heat treatments can be used to further increase the yield strengths and the yield strength ratio.

In yet another example, the first material of the club head 1000 can comprise Ti 6-6-2 titanium alloy having a first yield strength of approximately 1110 MegaPascals and the second material can comprise 431SS steel alloy having a second yield strength of approximately 724 MegaPascals, such that the yield strength ratio is approximately 0.65. In this example, various heat treatments can be used to further increase the yield strengths and the yield strength ratio.

In yet another example, the first material of the club head 1000 can comprise Ti-185 titanium alloy having a first yield strength of approximately 1448 MegaPascals and the second material can comprise 431SS steel alloy having a second yield strength of approximately 724 MegaPascals, such that the yield strength ratio is approximately 0.50. In this example, various heat treatments can be used to further increase the yield strengths and the yield strength ratio.

In yet another example, the first material of the club head 1000 can comprise a sheet 17-4 stainless steel having a first yield strength of approximately 1227 MegaPascals and the second material can comprise 431SS steel alloy having a second yield strength of approximately 724 MegaPascals, such that the yield strength ratio is approximately 0.59. In this example, various heat treatments can be used to further increase the yield strengths and the yield strength ratio.

In yet another example, the first material of the club head 1000 can comprise carpenter grade 455 steel having a first yield strength of approximately 1551 MegaPascals and the second material can comprise Ti 811 titanium alloy having a second yield strength of approximately 779 MegaPascals, such that the yield strength ratio is approximately 0.50. In this example, various heat treatments can be used to further increase the yield strengths and the yield strength ratio.

In yet another example, the first material of the club head 1000 can comprise Ti SSAT2041 titanium alloy having a first yield strength of approximately 1103 MegaPascals and the second material can comprise Ti 811 titanium alloy having a second yield strength of approximately 779 MegaPascals, such that the yield strength ratio is approximately 0.71. In this example, various heat treatments can be used to further increase the yield strengths and the yield strength ratio.

In yet another example, the first material of the club head 1000 can comprise Ti 15-5-3 titanium alloy having a first yield strength of approximately 1303 MegaPascals and the second material can comprise Ti 811 titanium alloy having a second yield strength of approximately 779 MegaPascals, such that the yield strength ratio is approximately 0.60. In this example, various heat treatments can be used to further increase the yield strengths and the yield strength ratio.

In yet another example, the first material of the club head 1000 can comprise Ti 3-8-6-4-4 titanium alloy having a first yield strength of approximately 1276 MegaPascals and the second material can comprise Ti 811 titanium alloy having a second yield strength of approximately 779 MegaPascals, such that the yield strength ratio is approximately 0.61. In this example, various heat treatments can be used to further increase the yield strengths and the yield strength ratio.

In yet another example, the first material of the club head 1000 can comprise Ti 10-2-3 titanium alloy having a first yield strength of approximately 1241 MegaPascals and the second material can comprise Ti 811 titanium alloy having a second yield strength of approximately 779 MegaPascals, such that the yield strength ratio is approximately 0.63. In this example, various heat treatments can be used to further increase the yield strengths and the yield strength ratio.

In yet another example, the first material of the club head 1000 can comprise Ti 15-3-3-3 titanium alloy having a first yield strength of approximately 1103 MegaPascals and the second material can comprise Ti 811 titanium alloy having a second yield strength of approximately 779 MegaPascals, such that the yield strength ratio is approximately 0.71. In this example, various heat treatments can be used to further increase the yield strengths and the yield strength ratio.

In yet another example, the first material of the club head 1000 can comprise Ti-9S titanium alloy having a first yield strength of approximately 965 MegaPascals and the second material can comprise Ti 811 titanium alloy having a second yield strength of approximately 779 MegaPascals, such that the yield strength ratio is approximately 0.81. In this example, various heat treatments can be used to further increase the yield strengths and the yield strength ratio.

In yet another example, the first material of the club head 1000 can comprise Ti 6-6-2 titanium alloy having a first yield strength of approximately 1110 MegaPascals and the second material can comprise Ti 811 titanium alloy having a second yield strength of approximately 779 MegaPascals, such that the yield strength ratio is approximately 0.70. In this example, various heat treatments can be used to further increase the yield strengths and the yield strength ratio.

In yet another example, the first material of the club head 1000 can comprise Ti-185 titanium alloy having a first yield strength of approximately 1448 MegaPascals and the second material can comprise Ti 811 titanium alloy having a second yield strength of approximately 779 MegaPascals, such that the yield strength ratio is approximately 0.54. In this example, various heat treatments can be used to further increase the yield strengths and the yield strength ratio.

In yet another example, the first material of the club head 1000 can comprise a sheet 17-4 stainless steel having a first yield strength of approximately 1227 MegaPascals and the second material can comprise Ti 811 titanium alloy having a second yield strength of approximately 779 MegaPascals, such that the yield strength ratio is approximately 0.63. In this example, various heat treatments can be used to further increase the yield strengths and the yield strength ratio.

In yet another example, the first material of the club head 1000 can comprise a quench and tempered steel alloy having a first yield strength of approximately 1655 MegaPascals and the second material can comprise a cast 17-4 steel alloy having a second yield strength of approximately 1138 MegaPascals, such that the yield strength ratio is approximately 0.0.69. In this example, various heat treatments can be used to further increase the yield strengths and the yield strength ratio.

In yet another example, the first material of the club head 1000 can comprise 455 steel alloy having a first yield strength of approximately 1551 MegaPascals and the second material can comprise a quench and tempered steel alloy having a second yield strength of approximately 1517 MegaPascals, such that the yield strength ratio is approximately 0.98. In this example, various heat treatments can be used to further increase the yield strengths and the yield strength ratio.

In yet another example, the first material of the club head 1000 can comprise 475 steel alloy having a first yield strength of approximately 1620 MegaPascals and the second material can comprise a quench and tempered steel alloy having a second yield strength of approximately 1517 MegaPascals, such that the yield strength ratio is approximately 0.94. In this example, various heat treatments can be used to further increase the yield strengths and the yield strength ratio.

In yet another example, the first material of the club head 1000 can comprise C300 steel alloy having a first yield strength of approximately 1848 MegaPascals and the second material can comprise a quench and tempered steel alloy having a second yield strength of approximately 1517 MegaPascals, such that the yield strength ratio is approximately 0.82. In this example, various heat treatments can be used to further increase the yield strengths and the yield strength ratio.

In yet another example, the first material of the club head 1000 can comprise Ti-15-5-3 titanium alloy having a first yield strength of approximately 1303 MegaPascals and the second material can comprise a quench and tempered steel alloy having a second yield strength of approximately 1517 MegaPascals, such that the yield strength ratio is approximately 1.16. In this example, various heat treatments can be used to further increase the yield strengths and the yield strength ratio.

In yet another example, the first material of the club head 1000 can comprise Ti-3-8-8-6-4 titanium alloy having a first yield strength of approximately 1276 MegaPascals and the second material can comprise a quench and tempered steel alloy having a second yield strength of approximately 1517 MegaPascals, such that the yield strength ratio is approximately 1.19. In this example, various heat treatments can be used to further increase the yield strengths and the yield strength ratio.

In yet another example, the first material of the club head 1000 can comprise Ti-10-2-3 titanium alloy having a first yield strength of approximately 1241 MegaPascals and the second material can comprise a quench and tempered steel alloy having a second yield strength of approximately 1517 MegaPascals, such that the yield strength ratio is approximately 1.22. In this example, various heat treatments can be used to further increase the yield strengths and the yield strength ratio.

Other combinations of first and second materials, as described above, can be used to achieve a high strength face while maintaining sufficient body strength to prevent peak stresses from leading to plastic deformation, cracking, or failure of club head 100 with repeated use. To accomplish this, any combination of the above described or other materials resulting in a yield strength ratio greater than 0.50, greater than 0.55, greater than 0.60, greater than 0.65, greater than 0.70, greater than 0.75, greater than 0.80, greater than 0.85, greater than 0.90, greater than 0.95, greater than 1.0, greater than 1.05, greater than 1.10, greater than 1.15, greater than 1.20, or greater than 1.25 can be used. Further, any combination of the above described or other materials resulting in a yield strength ratio between 0.5-1.2, between 0.6-1.1, between 0.7-1.0, between 0.5-0.8, between 0.8-1.0, or between 1.0-1.2 can be used.

In many embodiments, a thickness of face portion 113 at the face center of face portion 113 can be less than or equal to approximately 0.1905 centimeters, 0.2540 centimeters, 0.2794 centimeters, 0.3556 centimeters, or 0.3683 centimeters. In some of these embodiments, the thickness can be greater than or equal to approximately 0.1143 centimeters, 0.1270 centimeters, 0.1828 centimeters, or 0.1905 centimeters.

In many embodiments, face portion 113 can consist essentially of the first material. In these embodiments, the first material can account for at least 90%, 95% or 98% of a volume of face portion 113. In these or other embodiments, the first material can contribute account for at least 90%, 95% or 98% of a weighted average of the strength (e.g., yield strength and/or ultimate strength) of face portion 113.

In many embodiments, support body 114 can consist essentially of the second material. In these embodiments, the second material can account for at least 90%, 95% or 98% of a volume of support body 114. In these or other embodiments, the second material can contribute account for at least 90%, 95% or 98% of a weighted average of the strength (e.g., yield strength and/or ultimate strength) of support body 114.

In some embodiments, crown 108 and/or crown support body 115 can consist essentially of the second material. In these embodiments, the second material can account for at least 90%, 95% or 98% of a volume of crown 108 and/or crown support body 115, respectively. In these or other embodiments, the second material can contribute account for at least 90%, 95% or 98% of a weighted average of the strength (e.g., yield strength and/or ultimate strength) of crown 108 and/or crown support body 115, respectively.

In some embodiments, sole 109 and/or sole support body 116 can consist essentially of the second material. In these embodiments, the second material can account for at least 90%, 95% or 98% of a volume of sole 109 and/or sole support body 116, respectively. In these or other embodiments, the second material can contribute account for at least 90%, 95% or 98% of a weighted average of the strength (e.g., yield strength and/or ultimate strength) of sole 109 and/or sole support body 116, respectively.

Notably, club head 100 can comprise elements other than face portion 113 and support body 114, such as, for example, material coatings, weights, ornamentation, etc. Accordingly, the foregoing discussion of embodiments where face portion 113 consists essentially of the first material and/or where support body 113, crown 108, crown support body 115, sole 109, and/or sole support body 116 consists essentially of the second material is intended to make clear that in some embodiments, the elements of club head 100 that do not materially contribute to the structural integrity of club head 100 can be excluded from the concepts contemplated herein.

Further, in some embodiments, it may not be necessary that all of support body 114 comprise the second material. In these embodiments, it may be sufficient that only part of support body 114 comprises the second material. For example, it may be sufficient that support body 114 comprises the second material within a certain distance away from the loft plane of club head 100 and/or the area of club head 100 where face portion 113 couples and/or transitions to support body 114. For example, support body 114 can comprise the second material where support body 114 is within 0.20 centimeters, 0.30 centimeters, or 0.40 centimeters of the loft plane of club head 100 and/or the area of club head 100 where face portion 113 couples and/or transitions to support body 114. This distance can be measured in a direction parallel to a front-rear axis of club head 100.

Moreover, although the foregoing generally discusses on constraining strength ratios of face portion 113 to support body 114, these concepts can also be applied to other embodiments, such as, for example, where crown 108 is coupled to a remainder of club head 100 and/or where sole 109 is coupled to a remainder of club head 100. In these embodiments, crown 108 or sole 109 could be implemented with increased strength materials in comparison to the remainder of club head 100. However, generally, applying these concepts to embodiments where face portion 113 is coupled to support body 114 may be more advantageous from the standpoint that face portion 113 may experience more impact stresses than crown 108 and/or sole 109. Nonetheless, it may be desirable to apply one these concepts in these other embodiments when club head 100 is manufactured according to a crown pull or sole pull approach, as opposed to a face pull approach.

Figure 2:
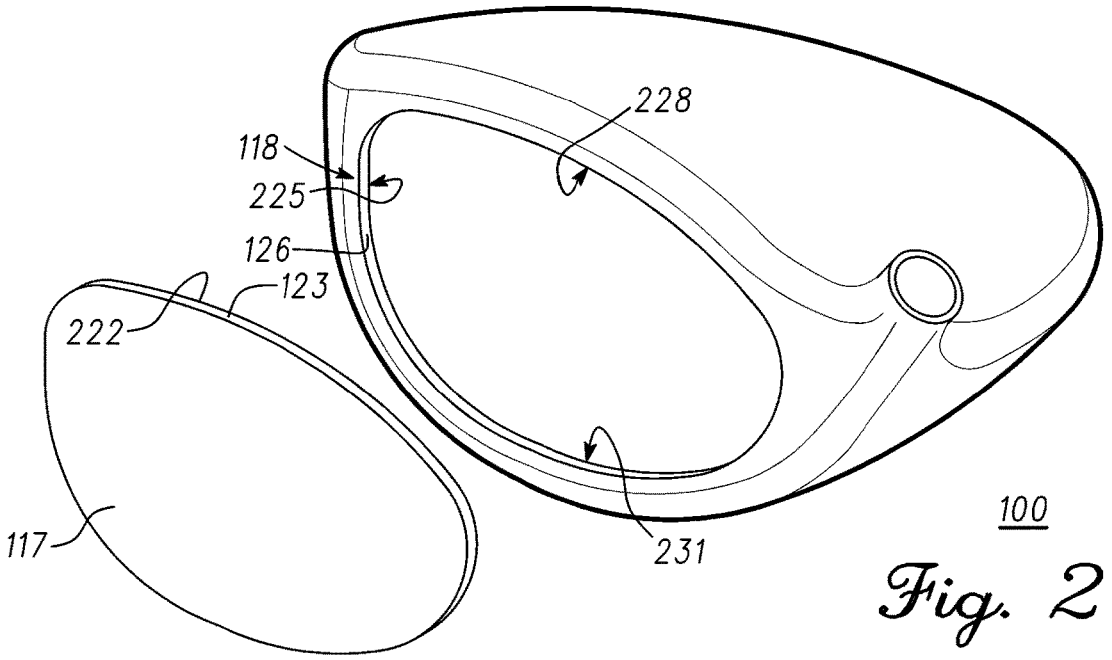
FIG. 2 illustrates the club head of FIG. 1 when a perimeter of a face insert of the club head is decoupled from a perimeter of a face support body of the club head, according to the embodiment of FIG. 1.

FIG. 2 illustrates club head 100 when perimeter 123 of face insert 117 is decoupled from perimeter 126 of face support body 118, according to the embodiment of FIG. 1. Notably, FIG. 2 is intended in part to provide visual context for rear surfaces 222, 225, 228, and 231.

Figure 3:
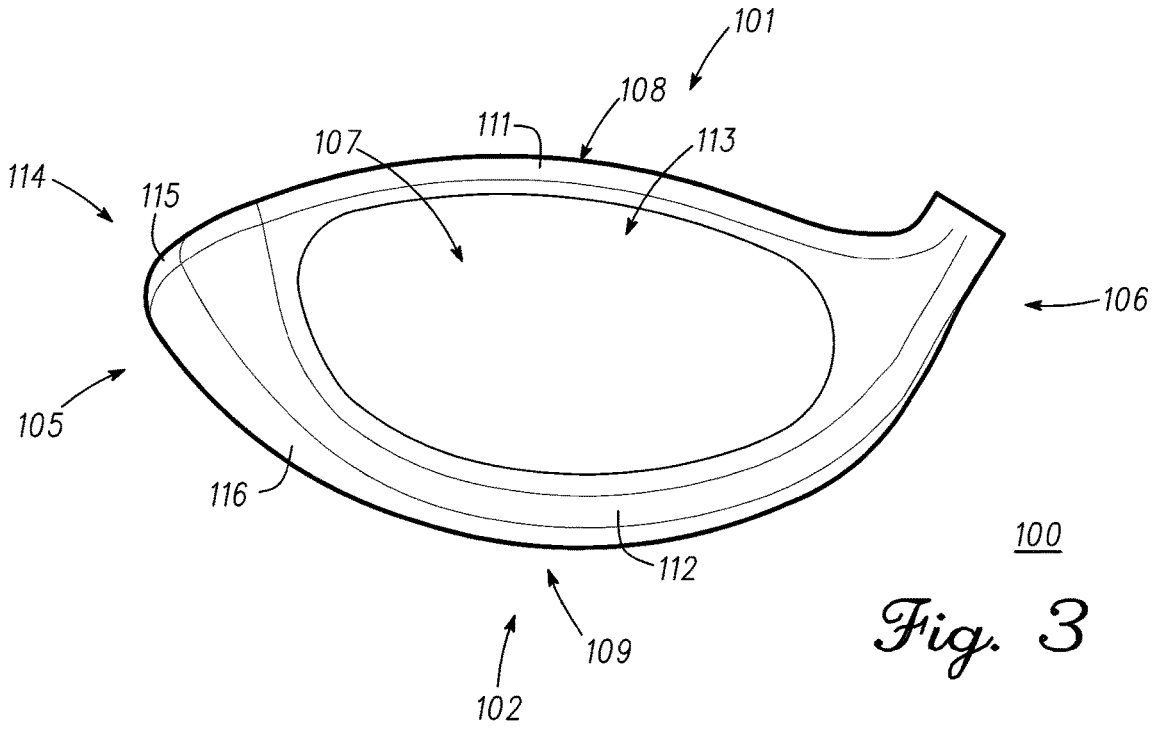
FIG. 3 illustrates a front view of the club head of FIG. 1, according to the embodiment of FIG. 1.
Figure 4:
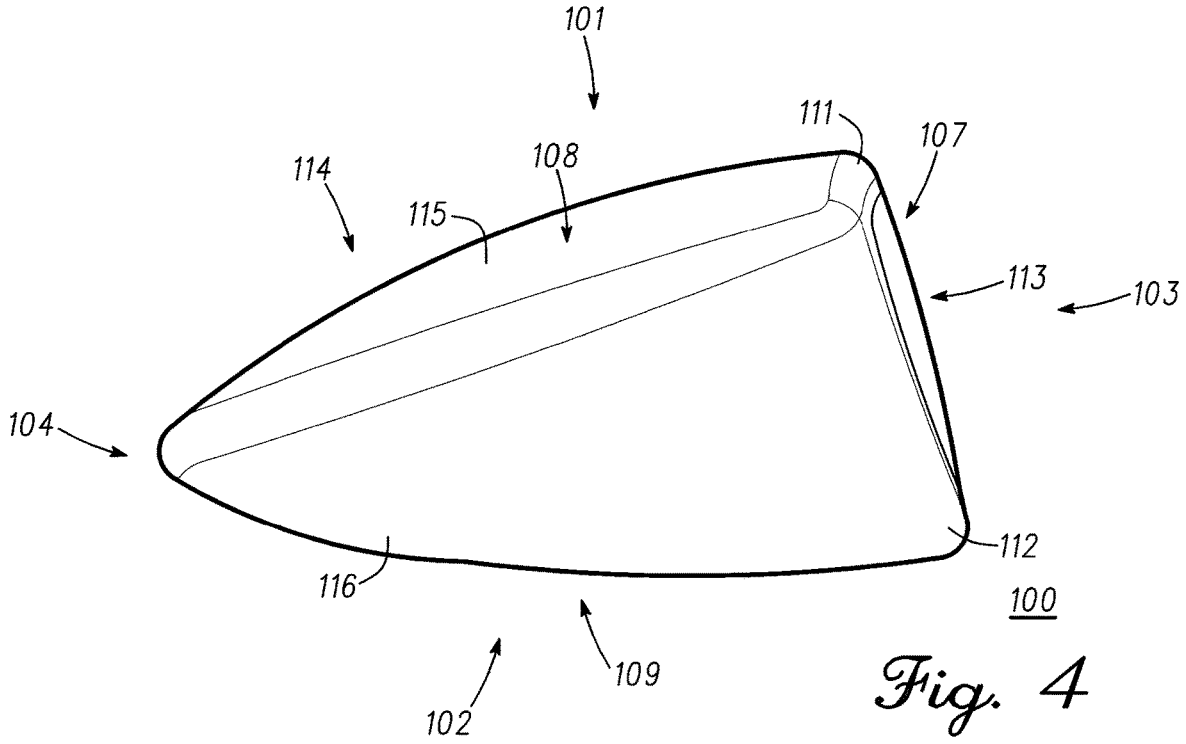
FIG. 4, illustrates a toe side view of the club head of FIG. 1, according to the embodiment of FIG. 1.
Figure 5:
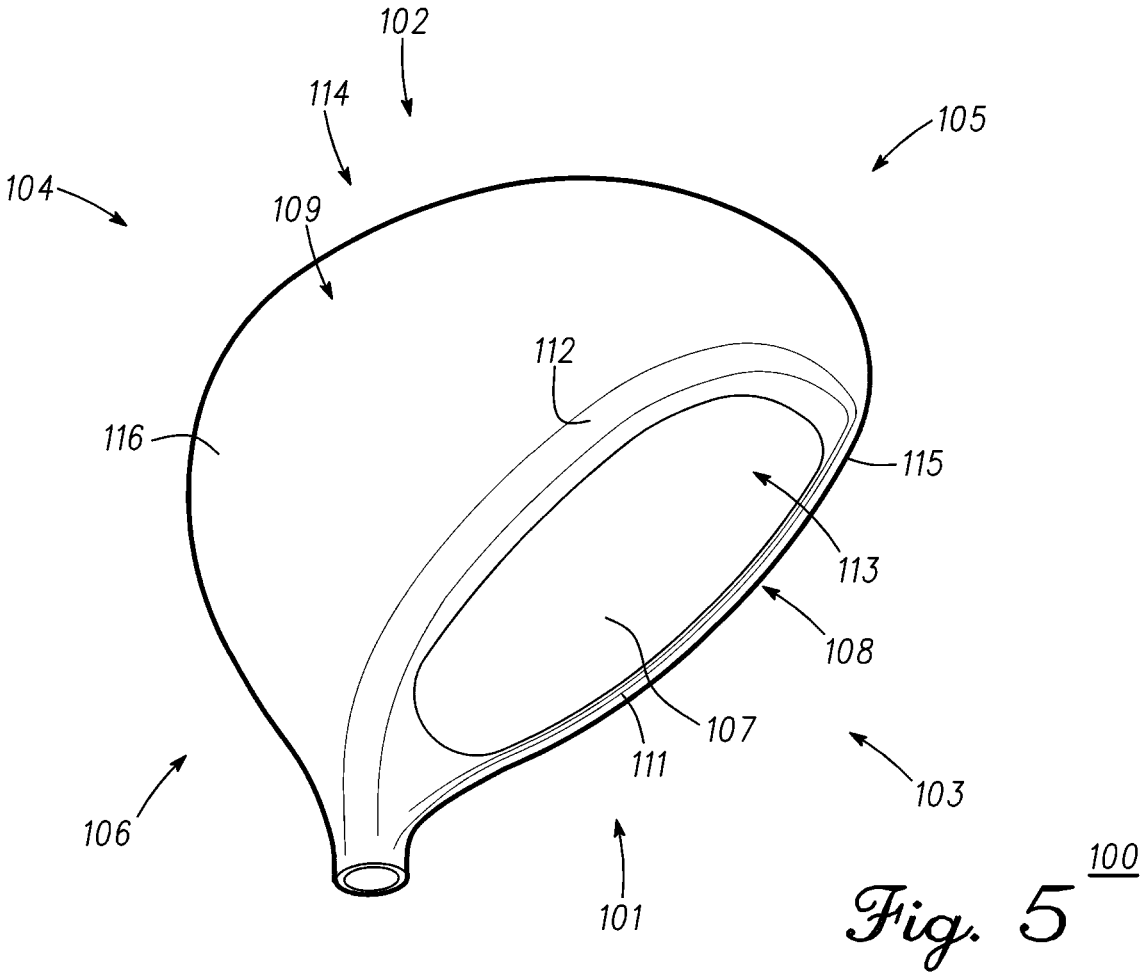
FIG. 5 illustrates a front, bottom, heel side view of the club head of FIG. 1, according to the embodiment of FIG. 1.

Meanwhile, FIGS. 3-5 illustrate club head 100 from other views. Specifically, FIG. 3 illustrates a front view of club head 100, according to the embodiment of FIG. 1; FIG. 4, illustrates a toe side view of club head 100, according to the embodiment of FIG. 1; and FIG. 5 illustrates a front, bottom, heel side view of club head 100, according to the embodiment of FIG. 1.

Figure 6:
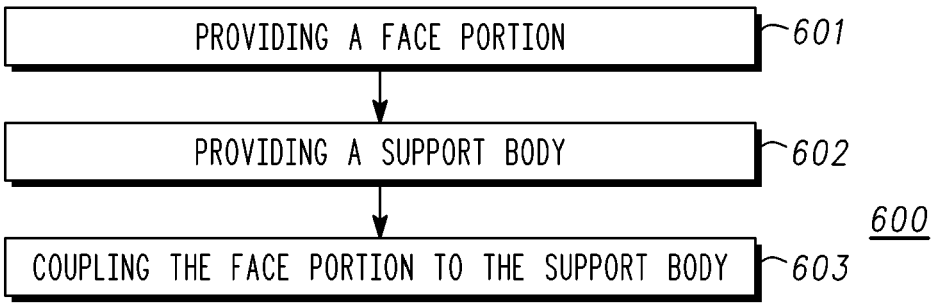
FIG. 6 illustrates a flow chart for an embodiment of a method of manufacturing a golf club head.

Turning ahead in the drawings, FIG. 6 illustrates a flow chart for an embodiment of method 600 of manufacturing a golf club head. Method 600 is merely exemplary and is not limited to the embodiments presented herein. Method 600 can be employed in many different embodiments or examples not specifically depicted or described herein. In some embodiments, the activities, the procedures, and/or the processes of method 600 can be performed in the order presented. In other embodiments, the activities, the procedures, and/or the processes of method 600 can be performed in any other suitable order. In still other embodiments, one or more of the activities, the procedures, and/or the processes in method 600 can be combined or skipped. In many embodiments, the club head can be similar or identical to club head 100 (FIGS. 1-5).

Figure 7:
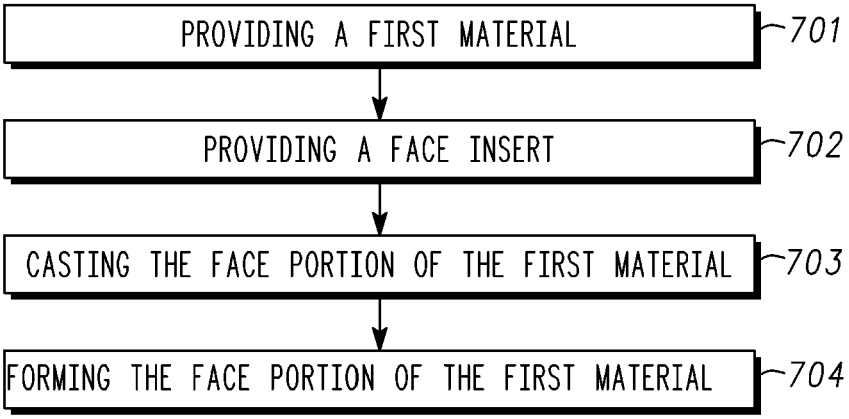
FIG. 7 illustrates an exemplary activity of providing a face portion, according to the embodiment of FIG. 6.

Method 600 can comprise activity 601 of providing a face portion. The face portion can be similar or identical to face portion 113 (FIGS. 1-5). FIG. 7 illustrates an exemplary activity 601.

Activity 601 can comprise activity 701 of providing a first material. The first material can be similar or identical to the first material described above with respect to club head 100 (FIGS. 1-5).

In many embodiments, activity 601 also can comprise activity 702 of providing a face insert. The face insert can be similar or identical to face insert 117 (FIGS. 1 & 2). In some embodiments, activity 702 can be omitted.

In some embodiments, activity 601 can further comprise activity 703 of casting the face portion of the first material.

In other embodiments, activity 601 can comprise activity 704 of forming the face portion of the first material. In many embodiments, when activity 704 is performed, activity 703 can be omitted, and vice versa.

Figure 8:
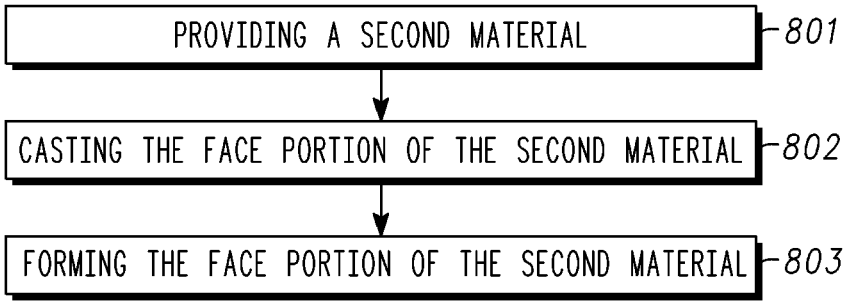
FIG. 8 illustrates an exemplary activity of providing a support body, according to the embodiment of FIG. 6.

Referring back to FIG. 6, method 600 can comprise activity 602 of providing a support body. The support body can be similar or identical to support body 114 (FIGS. 1-5). FIG. 8 illustrates an exemplary activity 602.

Activity 602 can comprise activity 801 of providing a second material. The second material can be similar or identical to the second material described above with respect to club head 100 (FIGS. 1-5).

Activity 602 also can comprise activity 802 of casting the face portion of the second material.

Activity 602 can comprise activity 803 of forming the face portion of the second material. In many embodiments, when activity 803 is performed, activity 802 can be omitted, and vice versa.

Referring again back to FIG. 6, method 600 can comprise activity 603 of coupling the face portion to the support body. Performing activity 603 can comprise coupling the face portion to the support body in any suitable manner, such as, for example, as provided for above with respect to club head 100 (FIGS. 1-5). In many embodiments, performing activity 603 can comprise welding the face portion to the support body.

Other embodiments can include (1) a method of manufacturing a golf club head comprising providing a crown and providing a remainder of the golf club head, and/or (2) a method of manufacturing a golf club head comprising providing a sole and providing a remainder of the golf club head. These embodiments can be similar to method 600 but with respect to a higher strength (e.g., yield strength and/or ultimate strength) crown or sole.

Although the golf club heads and related methods herein have been described with reference to specific embodiments, various changes may be made without departing from the spirit or scope of the present disclosure. For example, to one of ordinary skill in the art, it will be readily apparent that activities 601-603 of FIG. 6, activities 701-704 of FIG. 7, and/or activities 801-803 of FIG. 8 may be comprised of many different procedures, processes, and activities and be performed by many different modules, in many different orders, that any element of FIGS. 1-8 may be modified, and that the foregoing discussion of certain of these embodiments does not necessarily represent a complete description of all possible embodiments.

Further, while the above examples may be described in connection with a wood-type golf club head, the apparatus, methods, and articles of manufacture described herein may be applicable to other types of golf clubs such as an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a face portion comprising a first material having a first yield strength, the first yield strength being greater than or equal to approximately 1303 MegaPascals; and a support body comprising a second material having a second yield strength, the support body being configured to be coupled to the face portion, the second yield strength being greater than or equal to approximately 890 MegaPascals;

wherein:

the first material comprises a first titanium alloy;

the second material comprises a second titanium alloy;

the second material of the support body is only located within 0.40 centimeter from a region of the club head where the face portion transitions to the support body;

the first material of the face portion being subjected to a first heat treating step for approximately 60 minutes at a temperature equal to or greater than 600 degrees Celsius, followed by a quenching cooling process, followed by the first material being subjected to a second heat treating step for a period of time greater than 6 hours at a temperature greater than or equal to 500 degrees Celsius; and a yield strength ratio of the second yield strength to the first yield strength is greater than or equal to approximately 0.50.

2. The golf club head of claim 1 wherein:

the yield strength ratio is greater than or equal to approximately 0.63.

3. The golf club head of claim 1 wherein:

the first yield strength is greater than or equal to approximately 1378 MegaPascals.

4. The golf club head of claim 1 wherein:

the second yield strength is greater than or equal to 900 MegaPascals.

5. The golf club head of claim 1 wherein:

the first yield strength is greater than or equal to approximately 1655 MegaPascals.

6. The golf club head of claim 1 wherein:

the second yield strength is greater than or equal to approximately 1000 MegaPascals.

7. The golf club head of claim 1 wherein:

the face portion consists essentially of the first material.

8. The golf club head of claim 1 wherein:

the support body comprises a crown support body;

the golf club head comprises a crown, and the crown comprises the crown support body; and the crown support body consists essentially of the second material.

9. The golf club head of claim 1 wherein:

the support body comprises a sole support body;

the golf club head comprises a sole, and the sole comprises the sole support body; and the sole support body consists essentially of the second material.

10. The golf club head of claim 1 wherein:

the face portion comprises a face insert;

the golf club head comprises a face comprising the face insert; and the face insert comprises a face insert front surface, a face insert rear surface opposite the face insert front surface, and a face insert perimeter edge.

11. The golf club head of claim 1 wherein:

the face portion comprises at least one of a crown face portion or a sole face portion;

the golf club head comprises a crown and a sole;

when the face portion comprises the crown face portion, the crown comprises the crown face portion; and when the face portion comprises the sole face portion, the sole comprises the sole face portion.

12. The golf club head of claim 1 wherein at least one of:

the first material comprises one of iron or titanium;

the second material comprises one of iron or titanium; or the face portion comprises a face center, and a thickness of the face portion at the face center is less than or equal to approximately 0.2540 centimeters.

13. The golf club head of claim 12 wherein:

the thickness of the face portion at the face center is less than or equal to approximately 0.1905 centimeters.

14. The golf club head of claim 1 wherein:

the golf club head comprises a wood-type golf club head.

15. A golf club head comprising:

a face portion comprising a first material having a first yield strength, the first yield strength being greater than or equal to approximately 1034 MegaPascals; and a support body comprising a second material having a second yield strength, the support body being configured to be coupled to the face portion;

wherein:

the second material of the support body is only located within 0.40 centimeter from a region of the club head where the face portion transitions to the support body;

the first material of the face portion being subjected to a first heat treating step for approximately 60 minutes at a temperature equal to or greater than 600 degrees Celsius, followed by a quenching cooling process, followed by the first material being subjected to a second heat treating step for a period of time greater than 6 hours at a temperature greater than or equal to 500 degrees Celsius; and a yield strength ratio of the second yield strength to the first yield strength is greater than or equal to approximately 0.50.

16. The golf club head of claim 15 wherein:

the yield strength ratio is greater than or equal to approximately 0.63.

17. The golf club head of claim 15 wherein:

the first yield strength is greater than or equal to approximately 1378 MegaPascals.

18. The golf club head of claim 15 wherein:

the second yield strength is greater than or equal to 900 MegaPascals.

19. A method of manufacturing a golf club head, the method comprising:

providing a face portion comprising a first material having a first yield strength, the first yield strength being greater than or equal to approximately 1378 MegaPascals; and providing a support body comprising a second material having a second yield strength, the support body being configured to be coupled to the face portion;

wherein:

the first material of the face portion being subjected to a first heat treating step for approximately 60 minutes at a temperature equal to or greater than 600 degrees Celsius, followed by a quenching cooling process, followed by the first material being subjected to a second heat treating step for a period of time greater than 6 hours at a temperature greater than or equal to 500 degrees Celsius;

the first material comprises a first titanium alloy;

the second material comprises a second titanium alloy having a second yield strength greater than or equal to 890 MegaPascals;

the second material of the support body is only located within 0.40 centimeter from a region of the club head where the face portion transitions to the support body; and a yield strength ratio of the second yield strength to the first yield strength is greater than or equal to approximately 0.50.

20. The method of claim 19 further comprising:

coupling the face portion to the support body, wherein:

coupling the face portion to the support body comprises welding the face portion to the support body.

* * * * *